US012527356B2

(12) United States Patent
Johnson et al.

(10) Patent No.: US 12,527,356 B2
(45) Date of Patent: Jan. 20, 2026

(54) NON-COMBUSTIBLE AEROSOL PROVISION SYSTEMS WITH ATOMIZER-FREE CONSUMABLES

(71) Applicant: RAI Strategic Holdings, Inc., Winston-Salem, NC (US)

(72) Inventors: Zachary Johnson, Winston-Salem, NC (US); Jason M. Short, Winston-Salem, NC (US); Charles Jacob Novak, Winston-Salem, NC (US); Alla Letfullina, Greensboro, NC (US); Royce Ferguson, Winston-Salem, NC (US); Mike Xiao, Chandler's Ford (GB); Richard Haines, Newbury (GB); Zachary Burchman, Chicago, IL (US); Tom Mckeon, Kansas City, MO (US); Matthew Nettenstrom, Bartlett, IL (US); Steve Schennum, Plainville, IL (US); Patrick Bailey, Charlotte, NC (US); T. J. Root, Charlotte, NC (US); Benjamin Gatti, Indian Trail, NC (US); Jeremy Losaw, Charlotte, NC (US); Raeshon McNeil, Charlotte, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 488 days.

(21) Appl. No.: 17/812,493

(22) Filed: Jul. 14, 2022

(65) Prior Publication Data

US 2023/0020470 A1 Jan. 19, 2023

Related U.S. Application Data

(60) Provisional application No. 63/222,267, filed on Jul. 15, 2021.

(51) Int. Cl.
*A24F 40/485* (2020.01)
*A24F 40/10* (2020.01)
*A24F 40/44* (2020.01)

(52) U.S. Cl.
CPC ..... *A24F 40/485* (2020.01); *A24F 40/10* (2020.01); *A24F 40/44* (2020.01)

(58) Field of Classification Search
CPC ..... A24F 40/40; A24F 40/10; A24F 40/485; A24F 40/44; A24F 40/42
See application file for complete search history.

(56) References Cited

U.S. PATENT DOCUMENTS 9,986,769 B1 6/2018 Liu et al.
10,065,005 B2 9/2018 Wilder et al.
(Continued)

FOREIGN PATENT DOCUMENTS

CN 204861164 U 12/2015
EP 3435793 A1 2/2019
WO WO-2017167511 A1 * 10/2017 ..... A24D 1/02

OTHER PUBLICATIONS

WIPO, International Search Report and Written Opinion for International Application No. PCT/IB2022/056510, Nov. 14, 2022, pp. 1-123.

*Primary Examiner* — Michael H. Wilson
*Assistant Examiner* — Daniel Edward Vakili
(74) *Attorney, Agent, or Firm* — Womble Bond Dickinson (US) LLP; Chris Humphrey; John V. Forcier

(57) ABSTRACT

The present disclosure provides a non-combustible aerosol provision system and consumables and aerosol generators for non-combustible aerosol provision systems. In various implementations, the non-combustible aerosol provision system comprises a control device that includes an outer housing defining a receiving chamber, a power source and a control component, an aerosol generator coupled to the
(Continued)

control device, and an atomizer-free consumable that includes a substrate for engagement with the aerosol generator. The consumable is configured to be removably coupled with one or both of the control device and the aerosol generator. The aerosol generator defines a vaporization chamber and is configured to heat the substrate to generate an aerosol.

12 Claims, 24 Drawing Sheets

(56) References Cited

U.S. PATENT DOCUMENTS

| | | | | |
|---|---|---|---|---|
| 10,274,539 | B2 | 4/2019 | Novak et al. | |
| 10,863,770 | B2 | 12/2020 | Mironov et al. | |
| 2015/0305406 | A1 | 10/2015 | Li et al. | |
| 2018/0296777 | A1* | 10/2018 | Terry | A61M 11/042 |
| 2019/0166907 | A1* | 6/2019 | Chung | A24F 40/485 |
| 2020/0077703 | A1* | 3/2020 | Monsalud, Jr. | H05B 3/46 |
| 2022/0015427 | A1* | 1/2022 | Lau | A24F 40/46 |

* cited by examiner

NON-COMBUSTIBLE AEROSOL PROVISION SYSTEMS WITH ATOMIZER-FREE CONSUMABLES

CROSS-REFERENCE TO RELATED APPLICATION(S)

The present application claims priority to and the benefit of U.S. Provisional Patent Application No. 63/222,267, entitled: NON-COMBUSTIBLE AEROSOL PROVISION SYSTEMS WITH ATOMIZER-FREE CONSUMABLES, filed on Jul. 15, 2021, the content of which is incorporated herein by reference in its entirety.

TECHNOLOGY FIELD

The present disclosure relates to non-combustible aerosol provision systems, such as smoking articles, and more particularly to non-combustible aerosol provision systems that utilize atomizer-free consumables and separate aerosol generators to generate heat for the production of an aerosol (e.g., smoking articles commonly referred to as electronic cigarettes). The smoking articles may be configured to heat an aerosol precursor, which may incorporate materials that may be made or derived from tobacco or otherwise incorporate tobacco, the precursor being capable of forming an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, non-combustible aerosol provision systems, and heat generating sources set forth in the background art described in U.S. Pat. No. 7,726,320 to Robinson et al., U.S. Pat. App. Pub. No. 2013/0255702 to Griffith Jr. et al., and U.S. Pat. App. Pub. No. 2014/0096781 to Sears et al., which are incorporated herein by reference in their entireties. See also, for example, the various types of smoking articles, non-combustible aerosol provision systems, and electrically powered heat generating sources referenced by brand name and commercial source in U.S. patent application Ser. No. 14/170,838 to Bless et al., filed Feb. 3, 2014, which is incorporated herein by reference in its entirety. It would be desirable to provide a non-combustible aerosol provision system with advantageous usability features.

BRIEF SUMMARY

Non-combustible aerosol provision systems refer to systems that release compounds from an aerosol-generating material without combusting the aerosol-generating material, such as electronic cigarettes, tobacco heating products, and hybrid systems to generate aerosol using a combination of aerosol-generating material.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device.

In some embodiments, the disclosure relates to consumables comprising aerosol-generating material and configured to be used with non-combustible aerosol provision devices. These consumables are sometimes referred to as articles throughout the disclosure.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energized so as to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent.

In some embodiments, the consumable for use with the non-combustible aerosol provision device may comprise aerosol-generating material, an aerosol-generating material storage area, an aerosol-generating material transfer component, an aerosol generation area, a housing, a wrapper, a filter, a mouthpiece, an aerosol-modifying agent and/or structure for engaging an aerosol generator.

The present disclosure relates to non-combustible aerosol provision systems, methods of forming such devices, and elements of such devices. The disclosure particularly relates to a non-combustible aerosol provision system and an aerosol generator and consumable for use in a non-combustible aerosol provision system. In this regard, various embodiments of the disclosure provide a non-combustible aerosol provision system and/or a consumable with advantageous usability features. The present disclosure includes, without limitation, the following example implementations:

Embodiment 1: A non-combustible aerosol provision system comprises a control device that includes a power source, an aerosol generator that is removably coupled with the control device so as to receive power from the power source and generate an aerosol from a substrate, and a consumable that is removably coupled to one or both of the aerosol generator and the control device. The consumable includes a storage compartment configured to contain the substrate and is configured to supply the substrate to the aerosol generator.

Embodiment 2: A non-combustible aerosol provision system comprises a control device that includes a power source, an aerosol generator that is partially or fully embedded into the control device (either removably or non-removably) so as to receive power from the power source and generate an aerosol from a substrate, and a consumable that is removably coupled to one or both of the aerosol generator and the control device. The consumable includes a storage compartment configured to contain the substrate and is configured to supply the substrate to the aerosol generator.

Embodiment 3: The non-combustible aerosol provision system of any of Embodiments 1 and 2, or any combination thereof, wherein the control device includes an outer housing defining a proximal end and a distal end, the proximal end of the control device defining a receiving chamber for at least partially receiving the aerosol generator and the power source is disposed within the outer housing; the aerosol generator is coupled to the proximal end of the housing; and the consumable further comprises a mouthpiece having a proximal end configured to engage with a user's mouth and a distal end configured to engage a proximal end of the storage compartment, wherein the storage compartment has a distal end configured to engage the aerosol generator.

Embodiment 4: The non-combustible aerosol provision system of any of Embodiments 1 to 3, or any combination thereof, wherein the aerosol generator comprises a heater assembly and a liquid transport element, the liquid transport element configured to communicate with an aerosol precursor within the substrate.

Embodiment 5: The non-combustible aerosol provision system of any of Embodiments 1 to 4, or any combination thereof, wherein the aerosol generator further comprises a vaporization chamber and a vapor transport element.

Embodiment 6: The non-combustible aerosol provision system of any of Embodiments 1 to 5, or any combination thereof, wherein the distal end of the storage compartment comprises an elastomeric seal configured to engage with the aerosol generator to prevent leakage of, for example, ambient air, liquid, and/or the aerosol.

Embodiment 7: The non-combustible aerosol provision system of any of Embodiments 1 to 6, or any combination thereof, wherein the distal end of the storage compartment comprises a split valve (e.g., a split membrane or septum) configured to engage the aerosol generator and provide fluid communication between the storage compartment and the vaporization chamber. The liquid transport element may include a fluid delivery channel configured to engage the split valve of the storage compartment. The fluid delivery channel may include a rigid or semi-rigid structure, such as, for example, a tube or a cannula.

Embodiment 8: The non-combustible aerosol provision system of any of Embodiments 1 to 7, or any combination thereof, wherein the distal end of the storage compartment comprises a self-healing membrane configured to engage the aerosol generator and provide fluid communication between the storage compartment and the vaporization chamber. The aerosol generator may include a sharpened fluid delivery device (e.g., a tube, a channel, or a cannula) that is configured to pierce the self-healing membrane to provide the fluid communication between the storage compartment and the vaporization chamber.

Embodiment 9: The non-combustible aerosol provision system of any of Embodiments 1 to 8, or any combination thereof, wherein the distal end of the storage compartment comprises a slit valve configured to engage the aerosol generator and provide fluid communication between the storage compartment and the vaporization chamber. The liquid transport element may include a fluid delivery channel configured to engage the slit valve of the storage compartment. The fluid delivery channel may include a rigid or semi-rigid structure, such as, for example, a tube or a cannula.

Embodiment 10: The non-combustible aerosol provision system of any of Embodiments 1 to 9, or any combination thereof, wherein the aerosol generator comprises a heater assembly and a housing disposed at least partially about the heater assembly and defining a vaporization chamber, the housing including an access door configured to be opened by a portion of a distal end of the storage compartment when the storage compartment engages the aerosol generator.

Embodiment 11: The non-combustible aerosol provision system of any of Embodiments 1 to 10, or any combination thereof, wherein the storage compartment comprises an exterior wall defining an interior cavity having at least one side wall, a proximal end wall, and a distal end wall, a reservoir disposed within the interior cavity and defined by at least one side wall spaced inwardly from the exterior wall, the proximal end wall of the interior cavity, and a liquid transport assembly disposed at a distal end of the reservoir, and an access door disposed within the distal end wall and configured to be opened by a portion of the heater assembly when the storage compartment engages the aerosol generator so as to position at least a portion of the liquid transport assembly within the vaporization chamber, for example proximate to or in contact with the heater assembly.

Embodiment 12: The non-combustible aerosol provision system of any of Embodiments 1 to 11, or any combination thereof, wherein the access doors of the aerosol generator and the storage compartment comprise an elastomeric baffle.

Embodiment 13: The non-combustible aerosol provision system of any of Embodiments 1 to 12, or any combination thereof, wherein the aerosol generator is removably coupled to the proximal end of the housing and/or defines a receptacle configured to receive at least a portion of the consumable.

Embodiment 14: The non-combustible aerosol provision system of any of Embodiments 1 to 13, or any combination thereof, wherein the aerosol generator is removably coupled to the housing via a first snap fit structure (or other type of latching mechanism) comprising a first portion disposed on an exterior surface of the aerosol generator and a mating second portion disposed within the receiving chamber, and the consumable is removably coupled to the aerosol generator via a second snap fit structure (or other type of latching mechanism) comprising a first portion disposed on an exterior surface of the consumable and a mating second portion disposed on an interior surface of the aerosol generator.

Embodiment 15: The non-combustible aerosol provision system of any of Embodiments 1 to 14, or any combination thereof, wherein the second snap-fit mechanism is configured to reinforce the first snap fit structure so as to prevent inadvertent removable of the aerosol generator from the housing, for example, by stiffening the aerosol generator body wall.

Embodiment 16: The non-combustible aerosol provision system of any of Embodiments 1 to 15, or any combination thereof, wherein actuation of the second snap-fit mechanism is configured to further deploy the first portion of the first snap fit structure in to the second portion of the first snap fit structure.

Embodiment 17: The non-combustible aerosol provision system of any of Embodiments 1 to 16, or any combination thereof, wherein the aerosol generator defines a receptacle configured to receive at least a portion of the consumable.

Embodiment 18: The non-combustible aerosol provision system of any of Embodiments 1 to 17, or any combination thereof, wherein the consumable defines a receptacle configured to receive at least a portion of the aerosol generator.

Embodiment 19: The non-combustible aerosol provision system of any of Embodiments 1 to 18, or any combination thereof, wherein the aerosol generator is removably coupled to the housing via a snap fit, a friction fit, or a latching mechanism.

Embodiment 20: The non-combustible aerosol provision system of any of Embodiments 1 to 19, or any combination thereof, wherein the consumable is removably coupled to the control device or the aerosol generator via a snap fit, a friction fit, or a latching mechanism.

Embodiment 21: The non-combustible aerosol provision system of any of Embodiments 1 to 20, or any combination thereof, wherein the storage compartment of the consumable comprises a reservoir and the substrate comprises a liquid composition.

Embodiment 22: The non-combustible aerosol provision system of any of Embodiments 1 to 21, or any combination thereof, wherein the control device further comprises a controller for controlling at least one function of the aerosol provision system.

Embodiment 23: The non-combustible aerosol provision system of any of Embodiments 1 to 22, or any combination thereof, wherein a vaporization chamber of the aerosol generator is in fluid communication with the consumable via two separate airflow channels that merge at the proximal end of the mouthpiece.

Embodiment 24: The non-combustible aerosol provision system of any of Embodiments 1 to 23, or any combination thereof, wherein an airflow inlet is defined by a gap between the consumable and one or both of the control device and the aerosol generator, the airflow entering a vaporization chamber of the aerosol generator and an aerosol flow exits the vaporization chamber via a first path and a second path, where the first and second paths may be oriented symmetrically. The first and second aerosol flow paths may extend through the consumable or at least partially about the consumable and, in some case may merge before exiting the consumable.

Embodiment 25: The non-combustible aerosol provision system of any of Embodiments 1 to 24, or any combination thereof, wherein the aerosol generator further comprises a buffering mechanism, such as, for example, a spring plate, a shaped and/or deformable element, configured to lessen impact between the consumable and the aerosol generator during coupling.

Embodiment 26: A consumable for use with a non-combustible aerosol provision system comprises a storage compartment configured to contain a substrate and a portal configured for selective passage of the substrate therethrough when the consumable engages an aerosol generator of the non-combustible aerosol provision system.

Embodiment 27: The consumable of the preceding Embodiment, wherein the consumable further comprises a mouthpiece having a proximal end and a distal end, the proximal end having an exit portal defined therethrough and the distal end configured to engage a proximal end of the storage compartment, wherein a distal end of the storage compartment at least partially defines the portal.

Embodiment 28: The consumable of any of Embodiments 26 to 27, or any combination thereof, wherein the portal comprises a split valve configured to engage the aerosol generator and provide fluid communication between the storage compartment and a vaporization chamber disposed in the aerosol generator.

Embodiment 29: The consumable of any of Embodiments 26 to 28, or any combination thereof, wherein the portal comprises a self-healing membrane configured to engage the aerosol generator and provide fluid communication between the storage compartment and a vaporization chamber disposed in the aerosol generator.

Embodiment 30: The consumable of any of Embodiments 26 to 29, or any combination thereof, wherein the portal comprises a slit valve configured to engage the aerosol generator and provide fluid communication between the storage compartment and a vaporization chamber disposed in the aerosol generator.

Embodiment 31: The consumable of any of Embodiments 26 to 30, or any combination thereof, wherein the portal comprises an elastomeric seal configured to engage with the aerosol generator to prevent leakage therebetween.

Embodiment 32: The consumable of any of Embodiments 26 to 31, or any combination thereof, wherein the storage compartment comprises an exterior wall defining an interior cavity having at least one side wall, a proximal end wall, and a distal end wall; and a reservoir disposed within the interior cavity and defined by at least one side wall spaced inwardly from the exterior wall, the proximal end wall of the interior cavity, and a liquid transport assembly disposed at a distal end of the reservoir, wherein at least a portion of the liquid transport assembly is disposed within a vaporization chamber disposed in the aerosol generator when the distal end of the storage compartment engages the aerosol generator.

Embodiment 33: The consumable of any of Embodiments 26 to 32, or any combination thereof, wherein the storage compartment further comprises an access door disposed within the distal end wall and configured to be opened by a portion of the aerosol generator when the distal end of the storage compartment engages the aerosol generator.

Embodiment 34: The consumable of any of Embodiments 26 to 33, or any combination thereof, wherein the reservoir is configured to hold a liquid composition comprising the aerosol precursor.

Embodiment 35: The consumable of any of Embodiments 26 to 34, or any combination thereof, wherein the consumable further comprises a latching mechanism disposed proximate the portal and configured to removably engage an aerosol generator.

Embodiment 36: The consumable of any of Embodiments 26 to 35, or any combination thereof, wherein the consumable further comprises two separate vapor paths that merge at the proximal end of the mouthpiece and configured to be in fluid communication with a vaporization chamber.

Embodiment 37: The consumable of any of Embodiments 26 to 36, or any combination thereof, wherein the liquid transport element comprises a buffering mechanism configured to lessen impact between the liquid transport element and a mating component.

Embodiment 38: An aerosol generator for use with a non-combustible aerosol provision system comprises a body that defines a vaporization chamber, a vaporizer within the body in communication with the vaporization chamber, and one or more electrical contacts configured to electrically couple the vaporizer to a power source, wherein the body has an end configured to receive a consumable of the non-combustible aerosol provision system so that a substrate from the consumable is deliverable to the vaporizer and an opposing end configured to engage a power source of the non-combustible aerosol provisions system.

Embodiment 39: The aerosol generator of the preceding Embodiment, wherein the aerosol generator further comprises a liquid transport element configured to provide fluid communication between the vaporization chamber and the substrate.

Embodiment 40: The aerosol generator of any of Embodiments 38 to 39, or any combination thereof, wherein the liquid transport element comprises a fluid delivery channel configured to engage the consumable. The fluid delivery channel may include a rigid or semi-rigid structure, such as, for example, a tube or a cannula).

Embodiment 41: The aerosol generator of any of Embodiments 38 to 40, or any combination thereof, wherein the liquid transport element comprises a sharpened fluid delivery device (e.g., a tube, a channel, or a cannula) that is configured to pierce the consumable.

Embodiment 42: The aerosol generator of any of Embodiments 38 to 41, or any combination thereof, wherein the body is configured to be removably secured within a housing of a control device comprising the power source.

Embodiment 43: The aerosol generator of any of Embodiments 38 to 42, or any combination thereof, wherein the end configured to receive the consumable comprises a receptacle configured to receive at least a portion of the consumable.

Embodiment 44: The aerosol generator of any of Embodiments 38 to 43, or any combination thereof, wherein the aerosol generator is removably coupled to the housing via a first snap fit structure (or other type of latching mechanism) comprising a first portion disposed on an exterior surface of the body and a mating second portion disposed within the housing, and the end configured to receive the consumable comprises a first portion of a second snap fit structure disposed therein and configured to mate with a second portion of the second snap fit structure.

Embodiment 45: The aerosol generator of any of Embodiments 38 to 44, or any combination thereof, wherein the aerosol generator comprises a first portion of a first latch mechanism disposed on an exterior surface of the body and configured to engage a second, mating portion of the first latch mechanism disposed on or in the housing and a first portion of a second latch mechanism disposed within the receptacle and configured to engage a second, mating portion of the second latch mechanism disposed on the consumable.

Embodiment 46: The aerosol generator of any of Embodiments 38 to 45, or any combination thereof, wherein the end configured to receive the consumable comprises an access door configured to shield the vaporizer and be opened when the aerosol generator engages the consumable.

Embodiment 47: The aerosol generator of any of Embodiments 38 to 46, or any combination thereof, further comprising a buffering mechanism disposed within the receptacle and configured to lessen impact between the vaporizer and a consumable receivable within the receptacle.

Embodiment 48: The aerosol generator of any of Embodiments 38 to 47, or any combination thereof, further comprising a vapor transport element.

Embodiment 49: The non-combustible aerosol provision system, consumable, or aerosol generator of any of Embodiments 1 to 48, or any combination thereof, further comprising a buffering mechanism (e.g., shaped wick, spring) configured to lessen impact between the consumable and the aerosol generator during coupling.

Embodiment 50: A kit comprising packaging that contains one or more of a control device, a consumable(s), and an aerosol generator(s).

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE FIGURES

Figure 1:
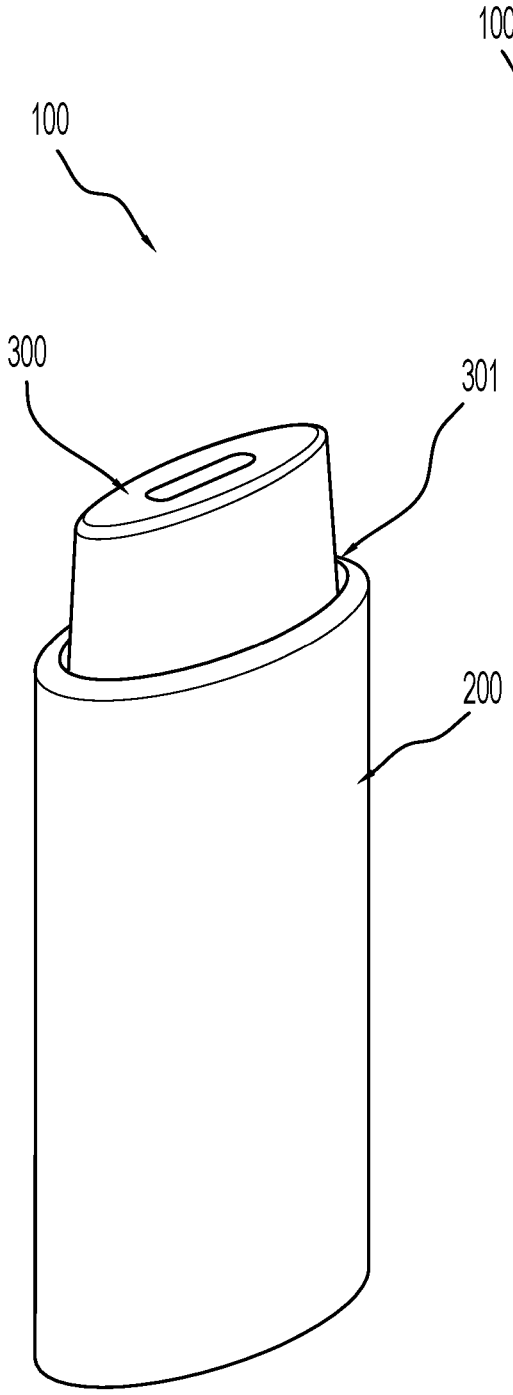
Figure 2:
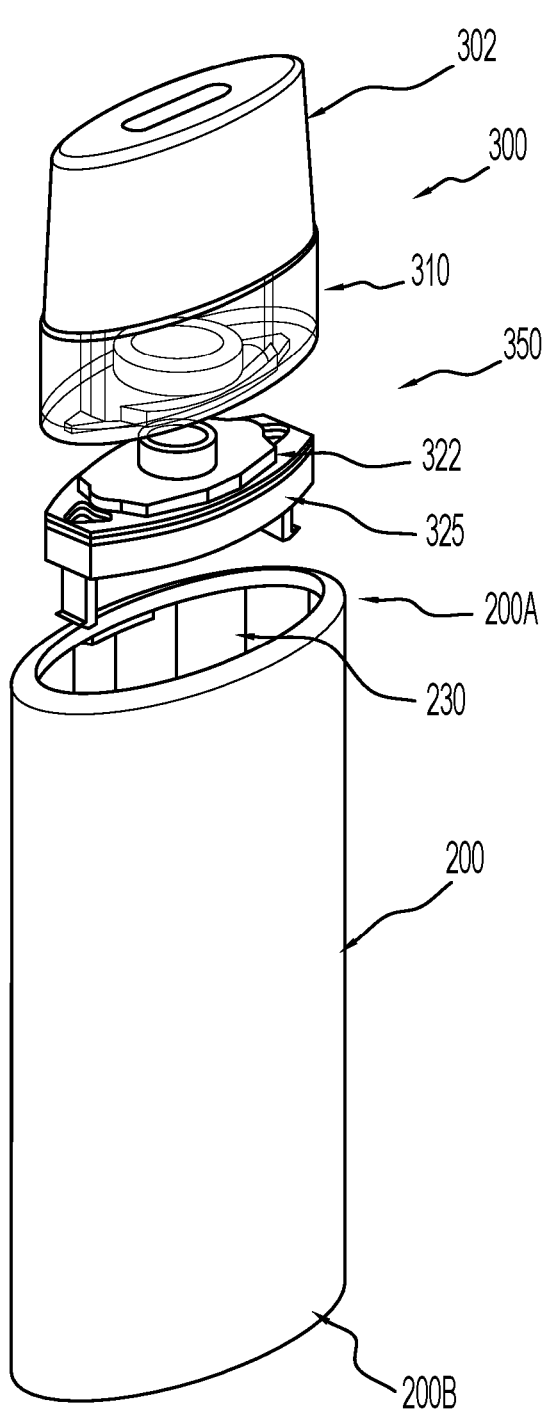
Figure 3:
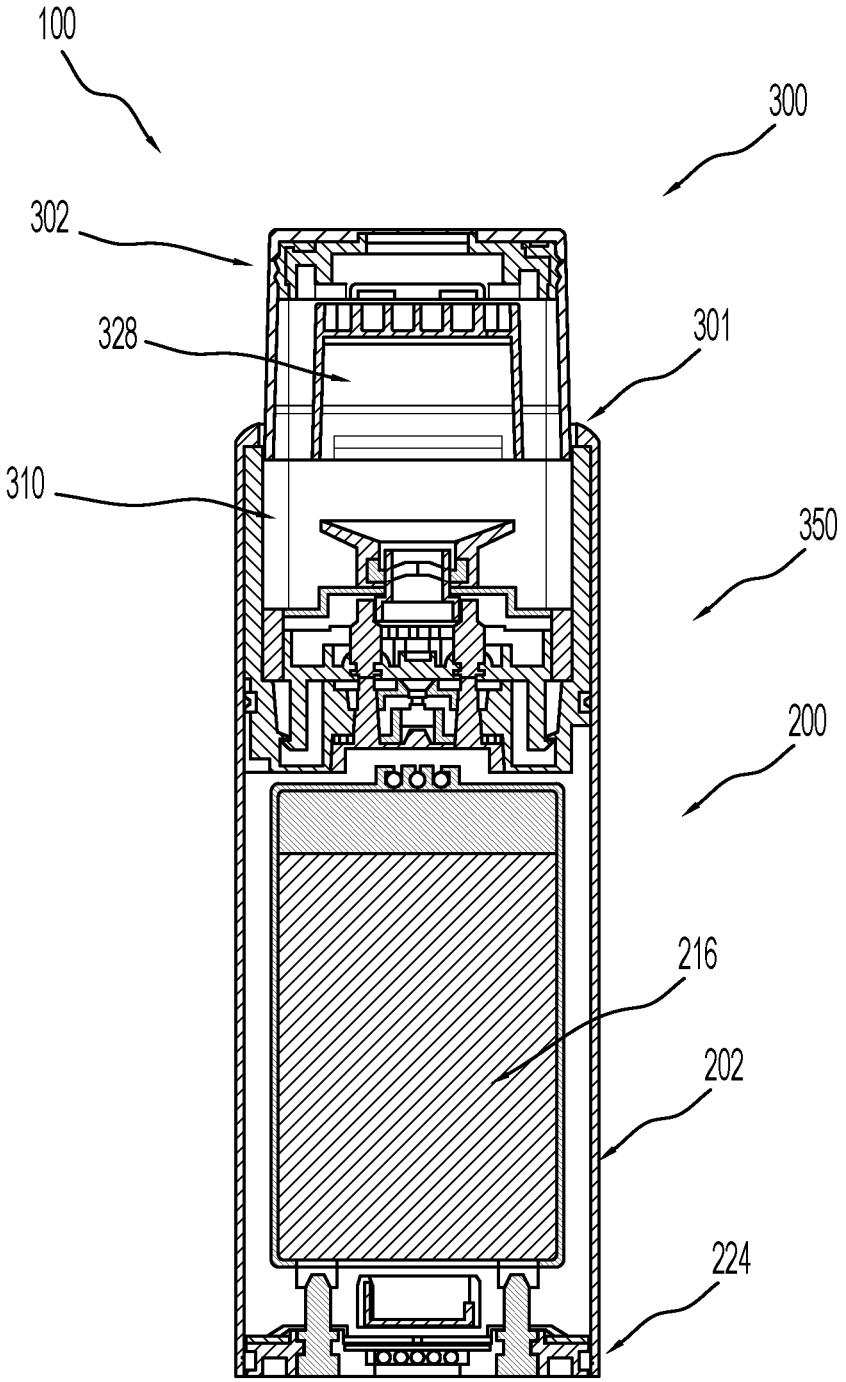
Figure 4A:
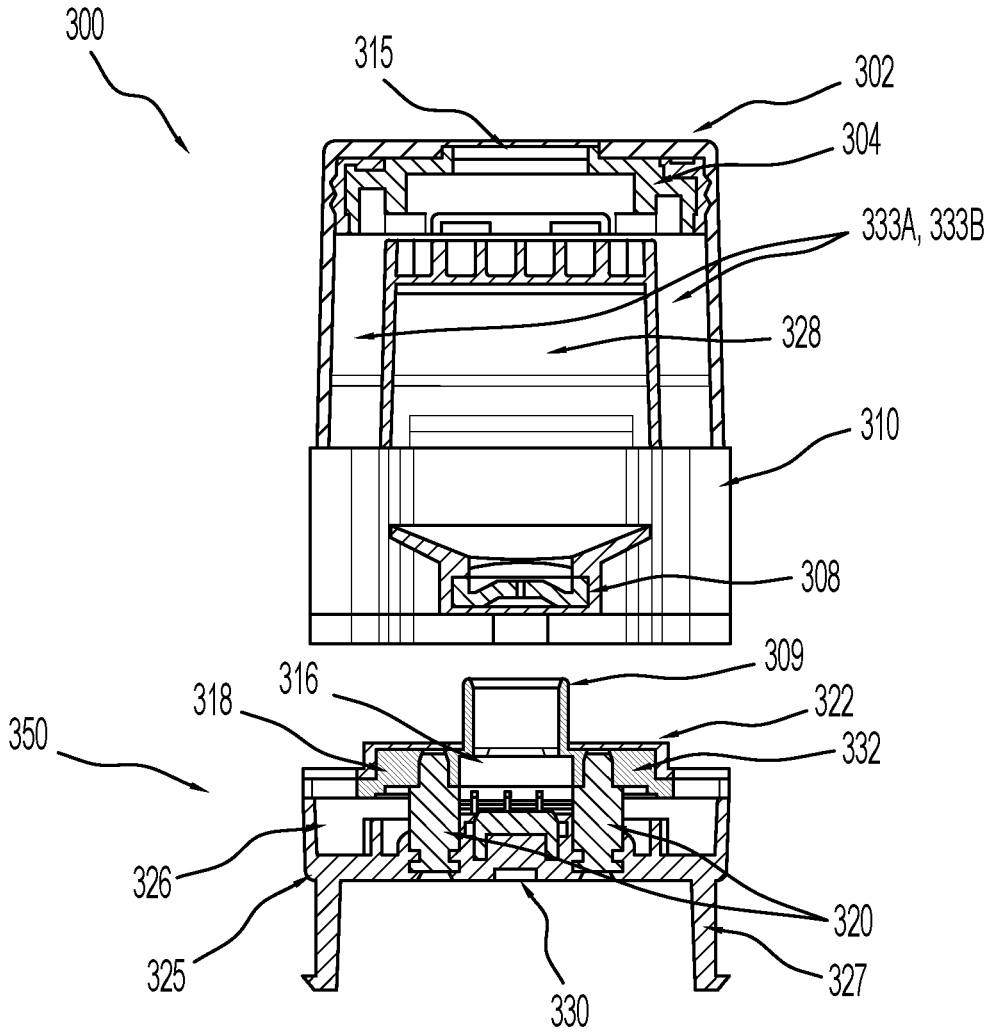
Figure 4B:
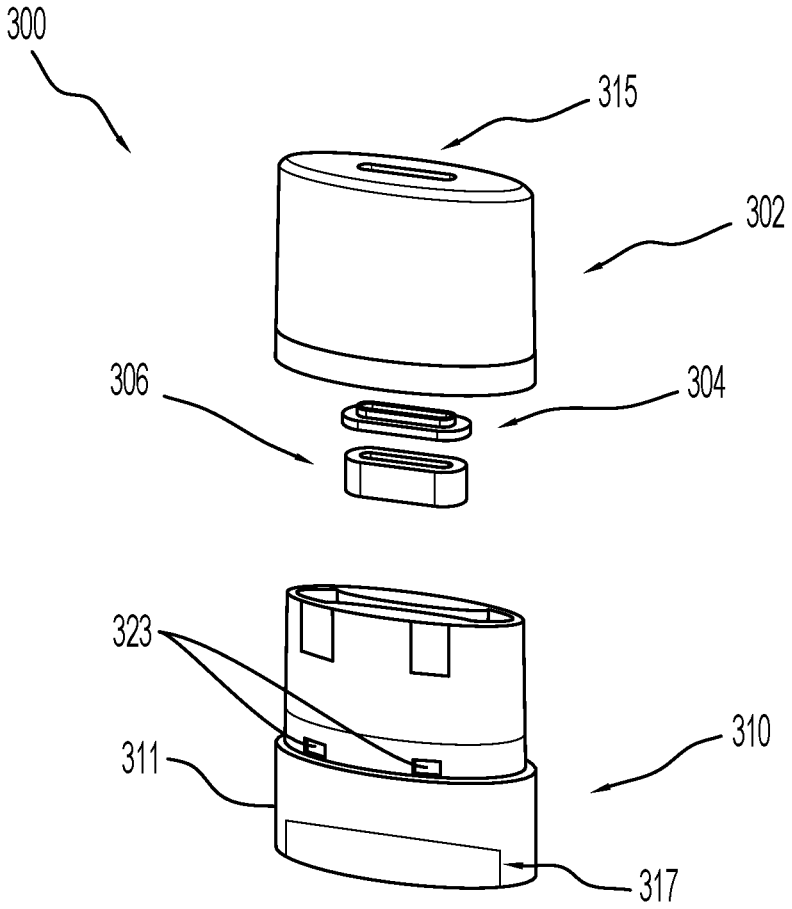
Figure 5:
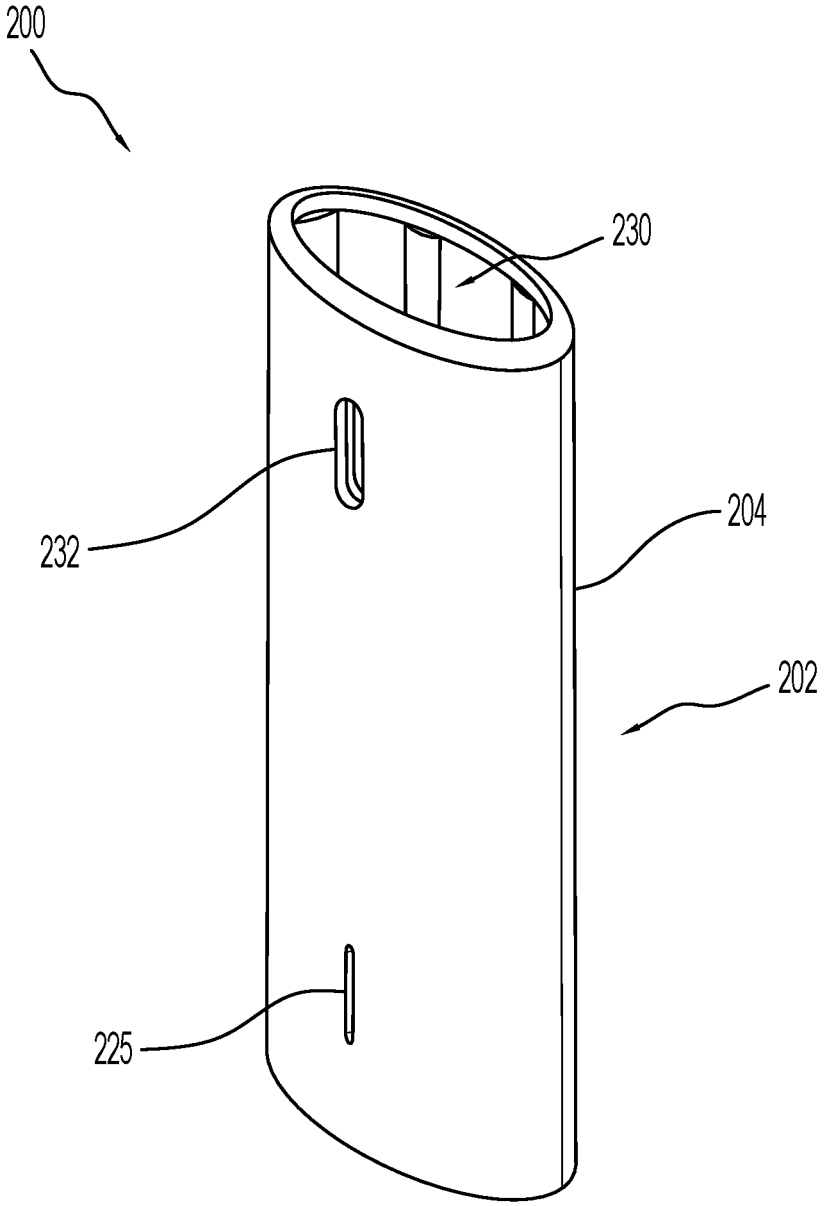
Figure 6:
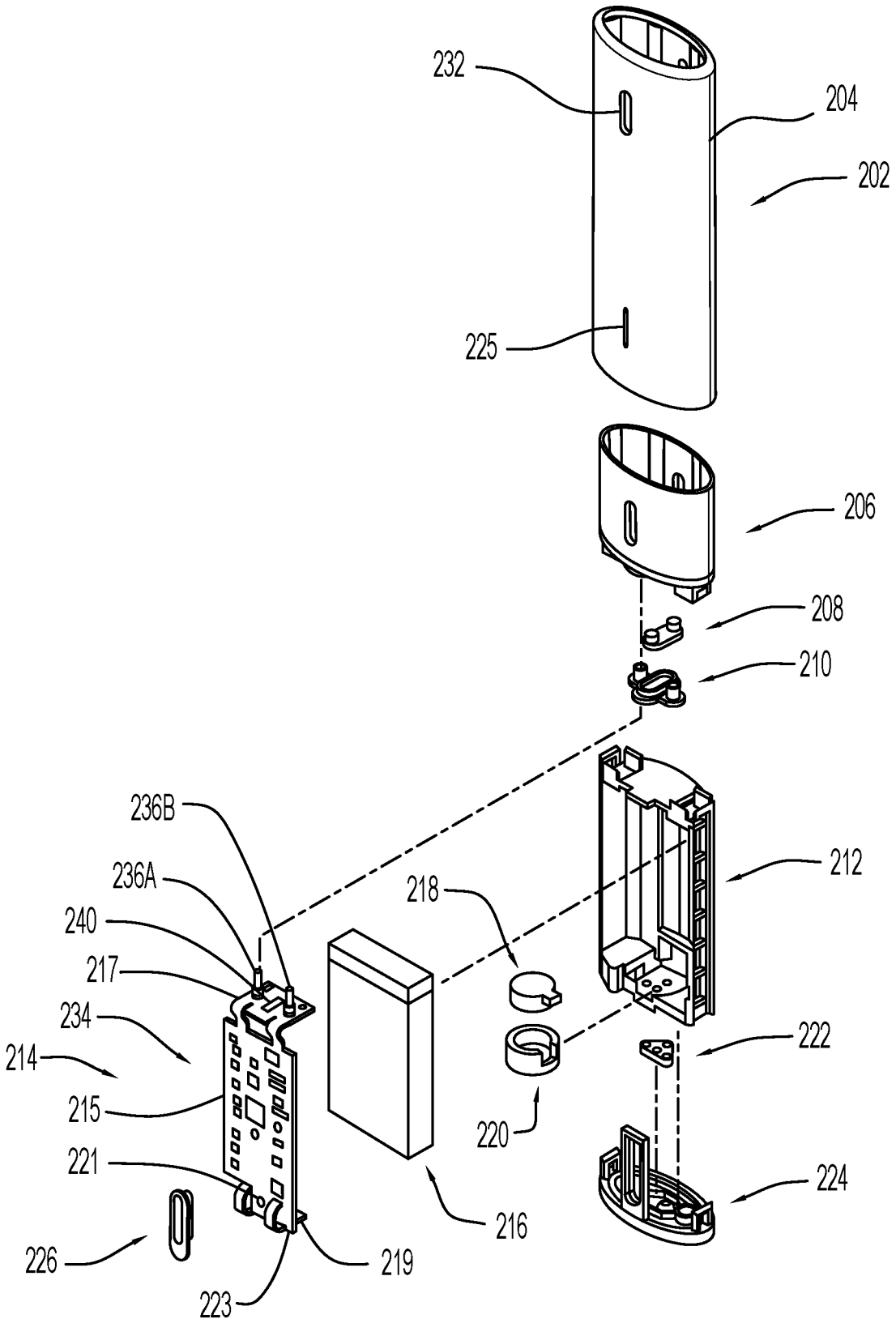
Figure 7A:
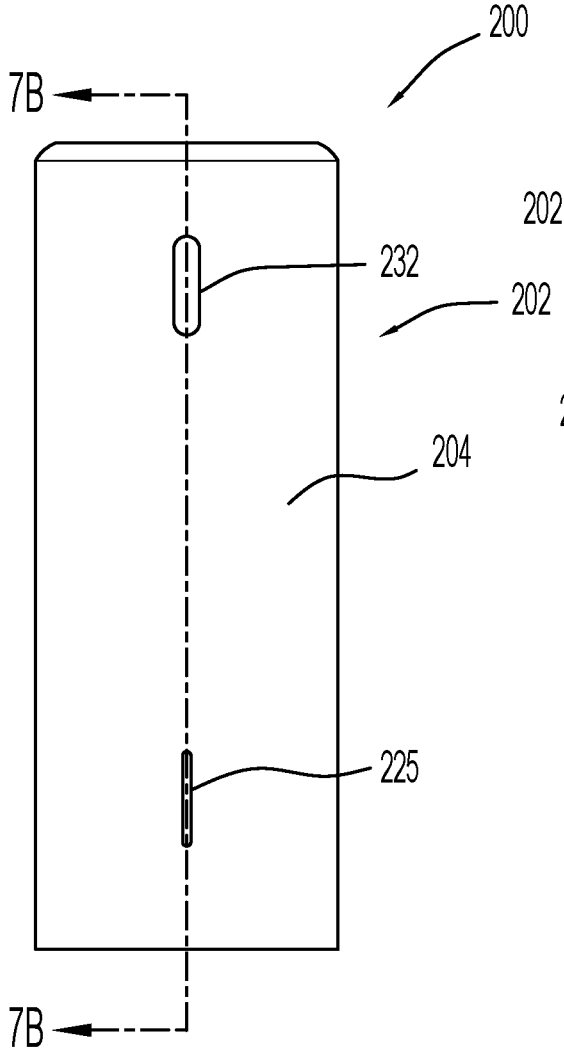
Figure 7B:
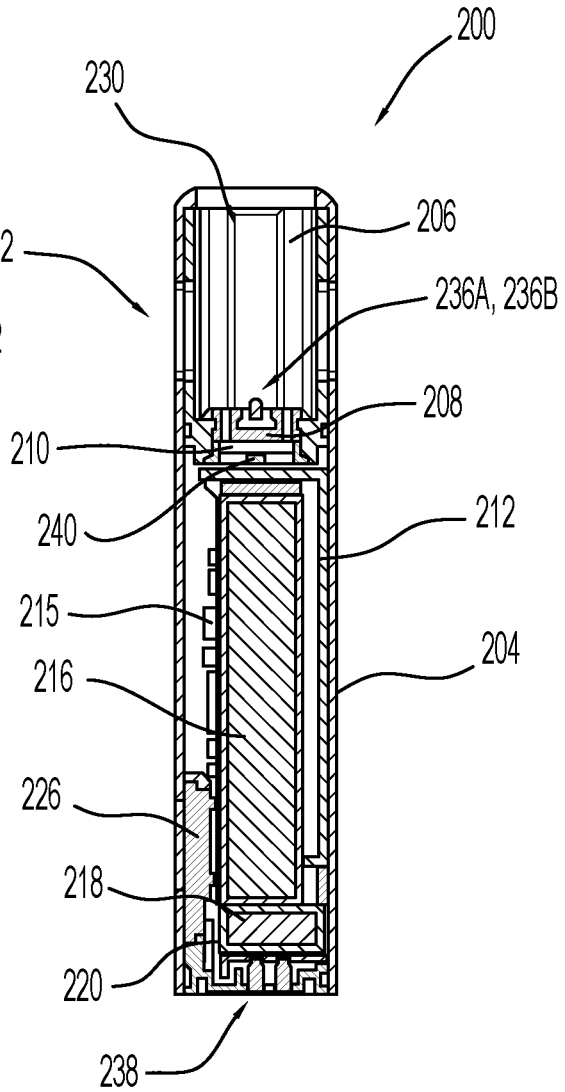
Figure 8A:
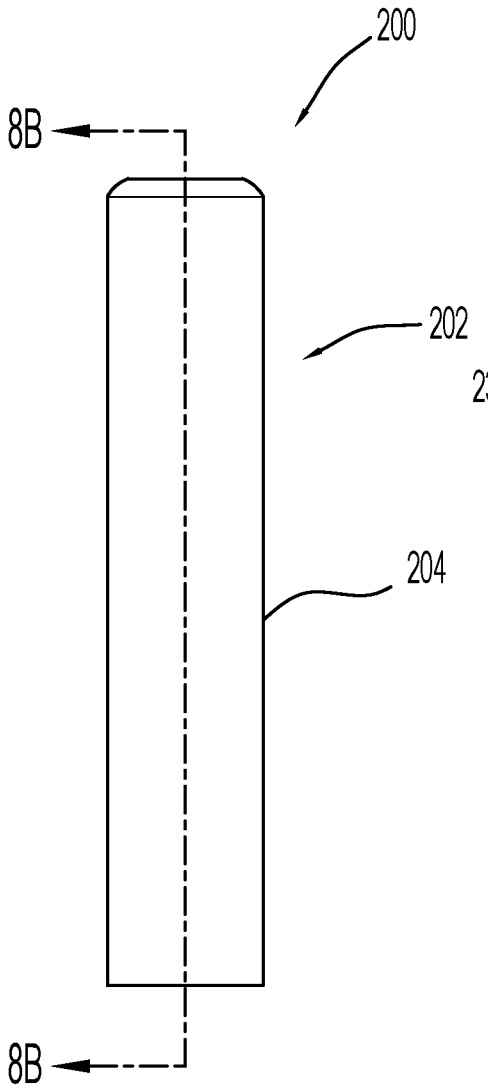
Figure 8B:
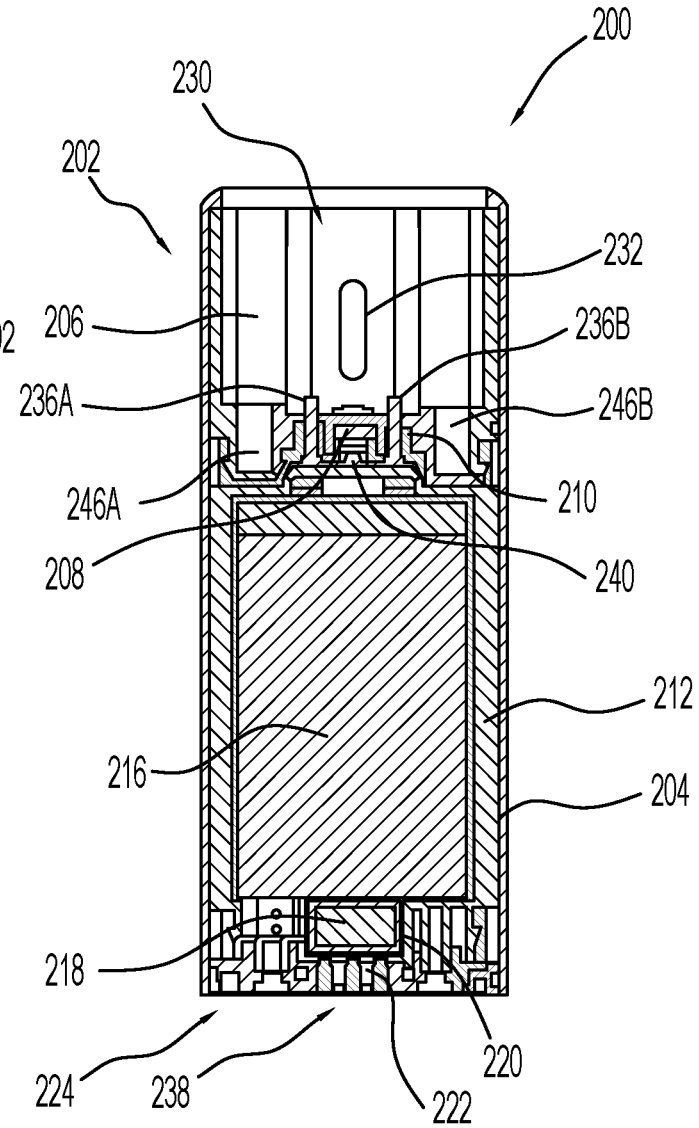
Figure 9:
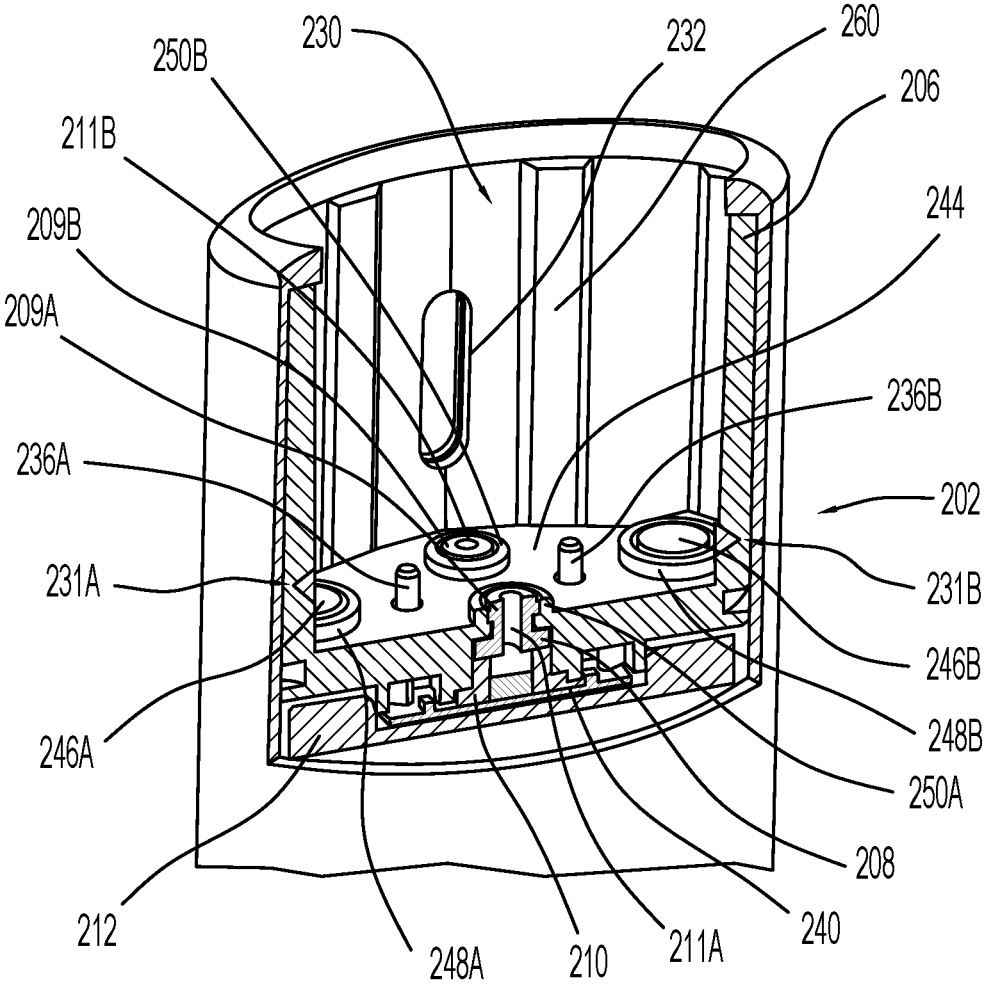
Figure 10A:
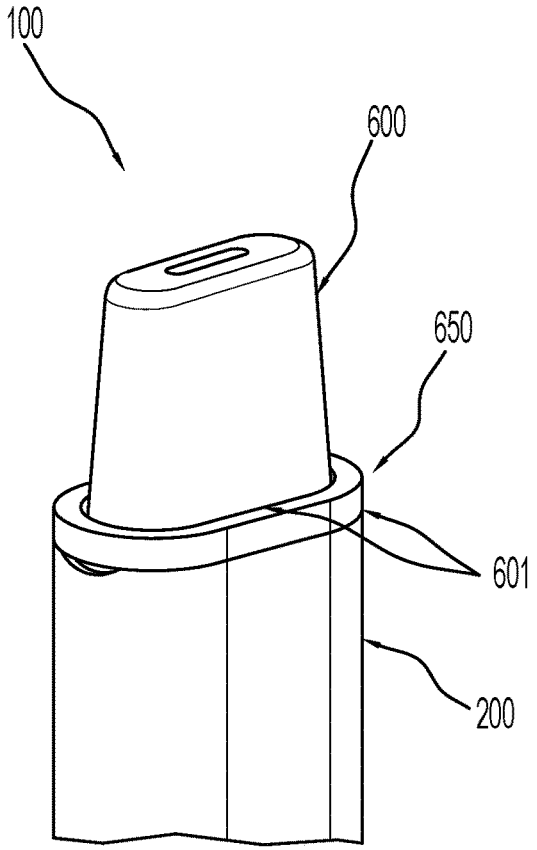
Figure 10B:
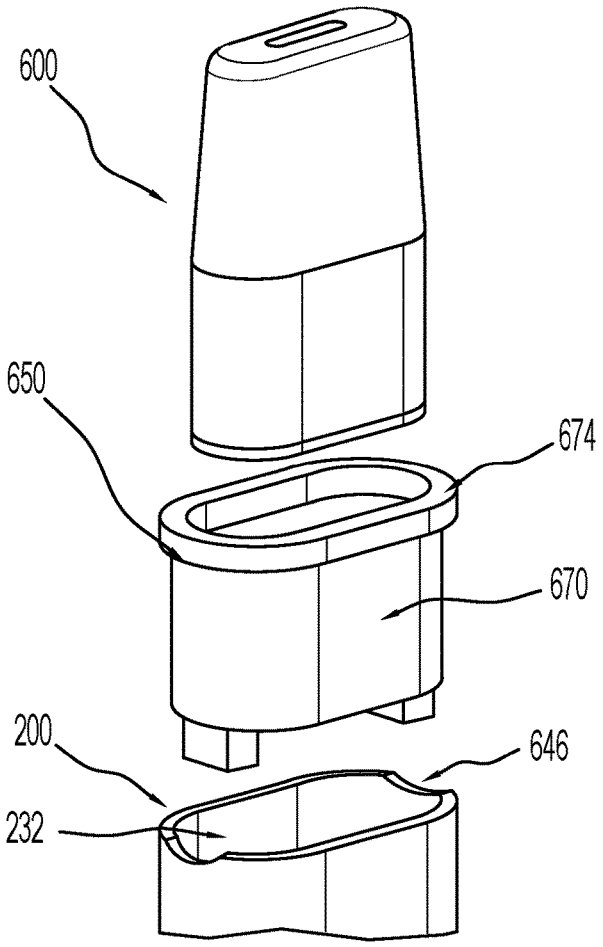
Figure 11:
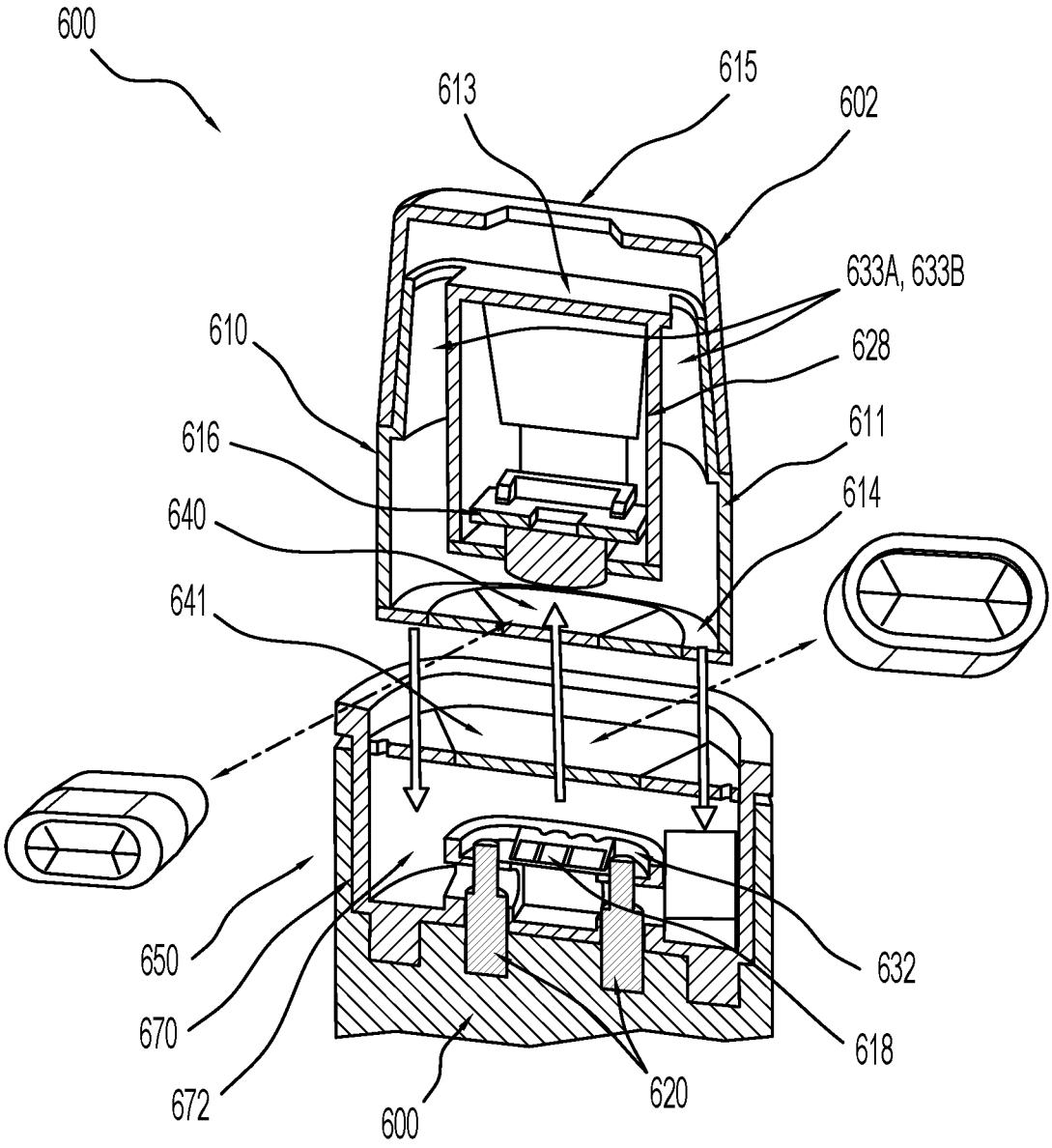
Figure 12A:
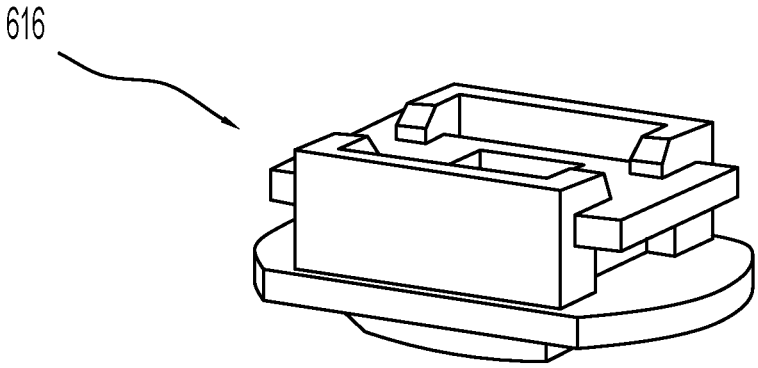
Figure 12B:
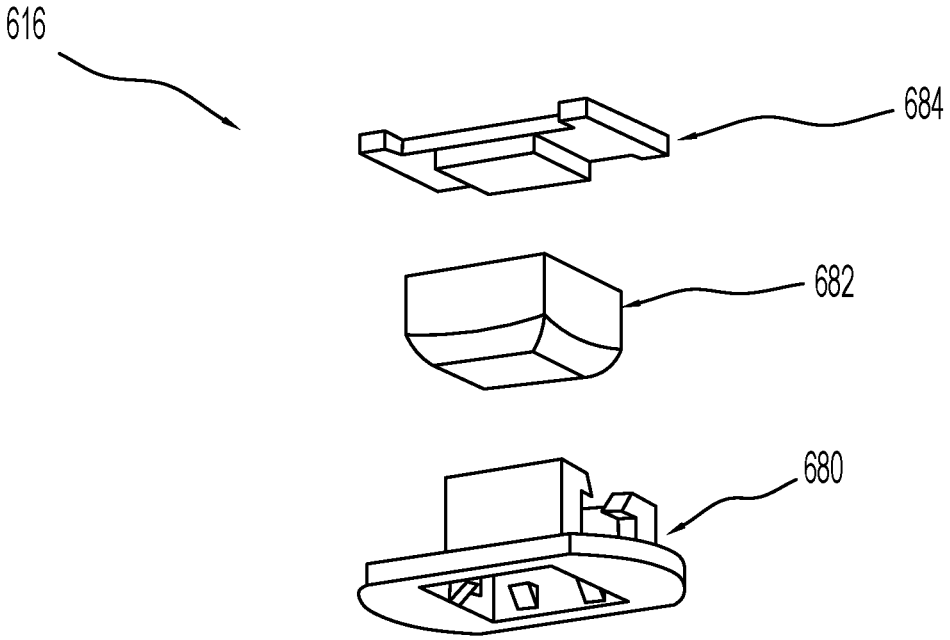
Figure 13A:
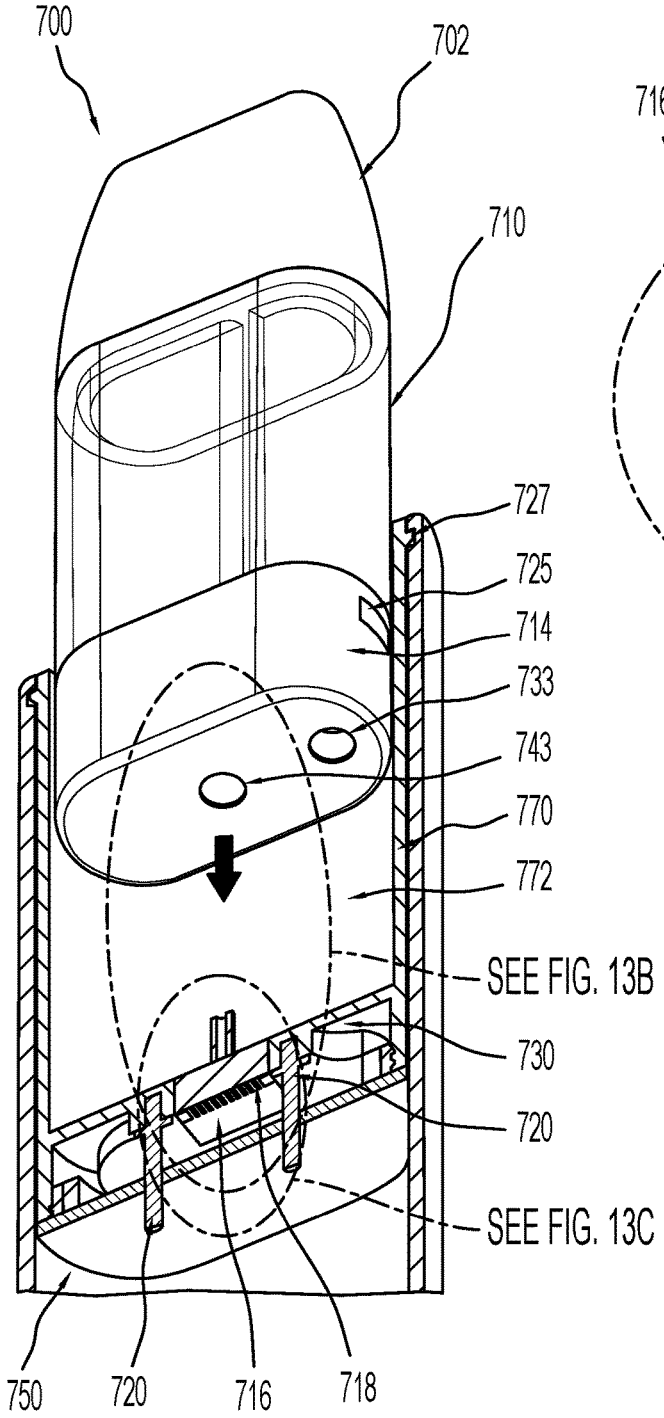
Figure 13B:
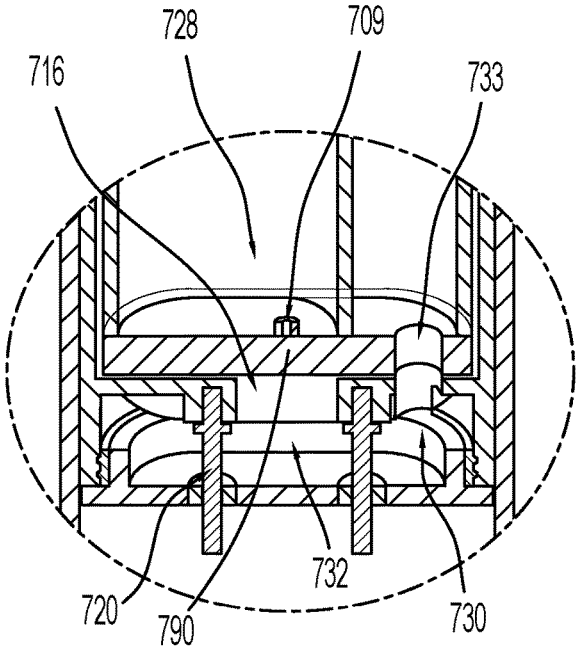
Figure 13C:
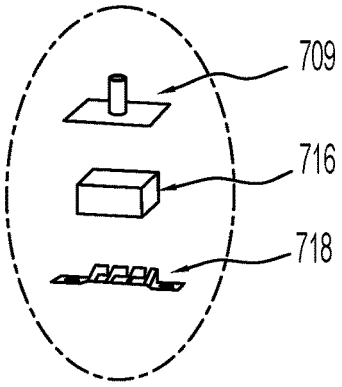
Figure 14A:
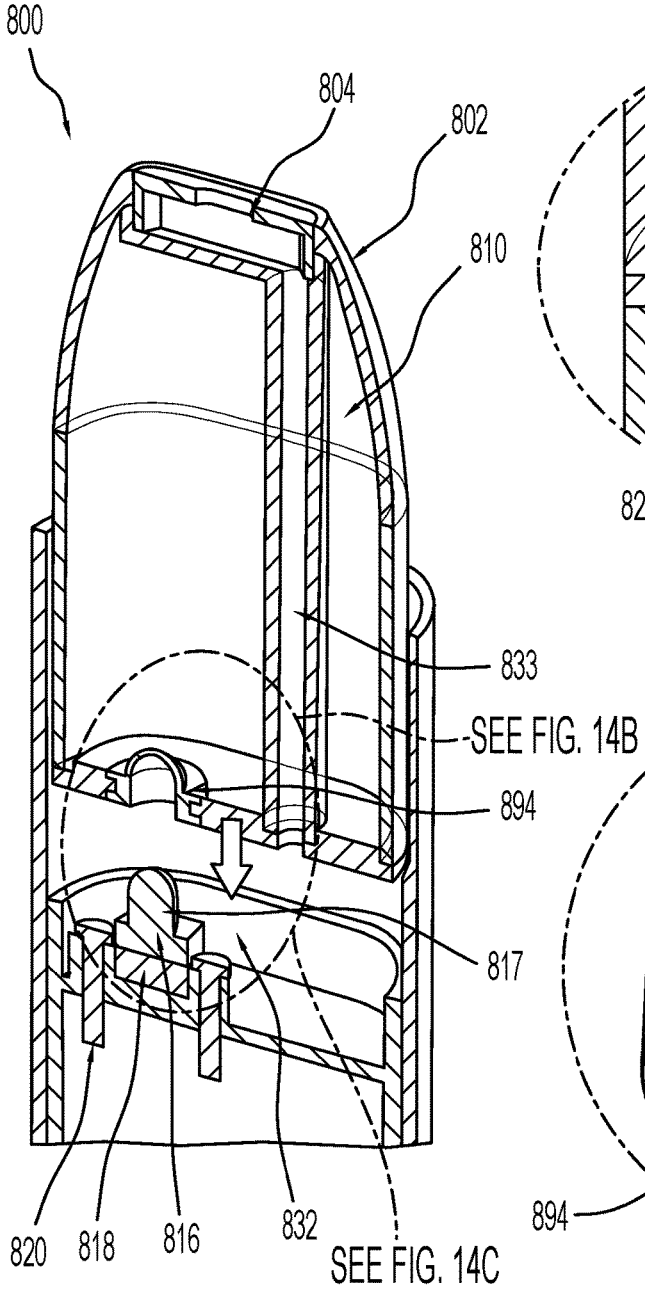
Figure 14B:
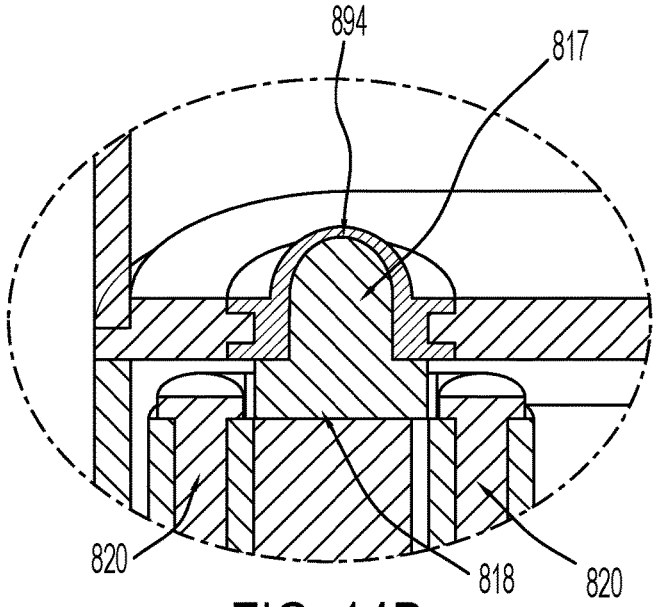
Figure 14C:
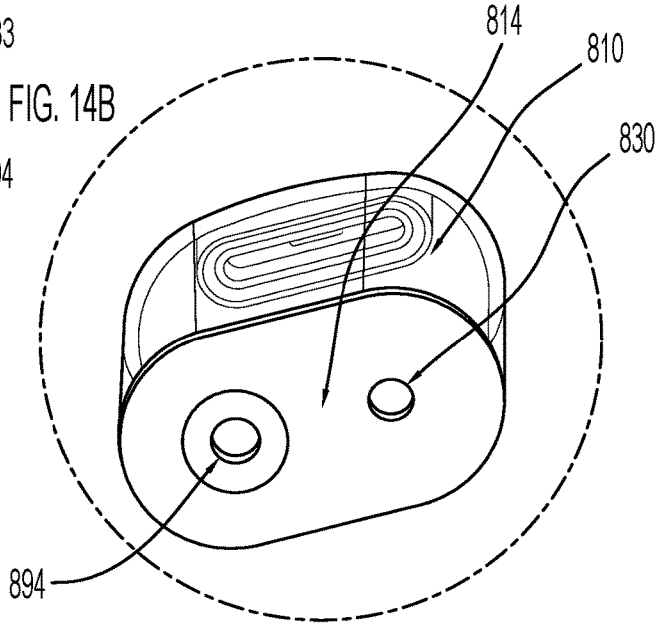
Figure 15:
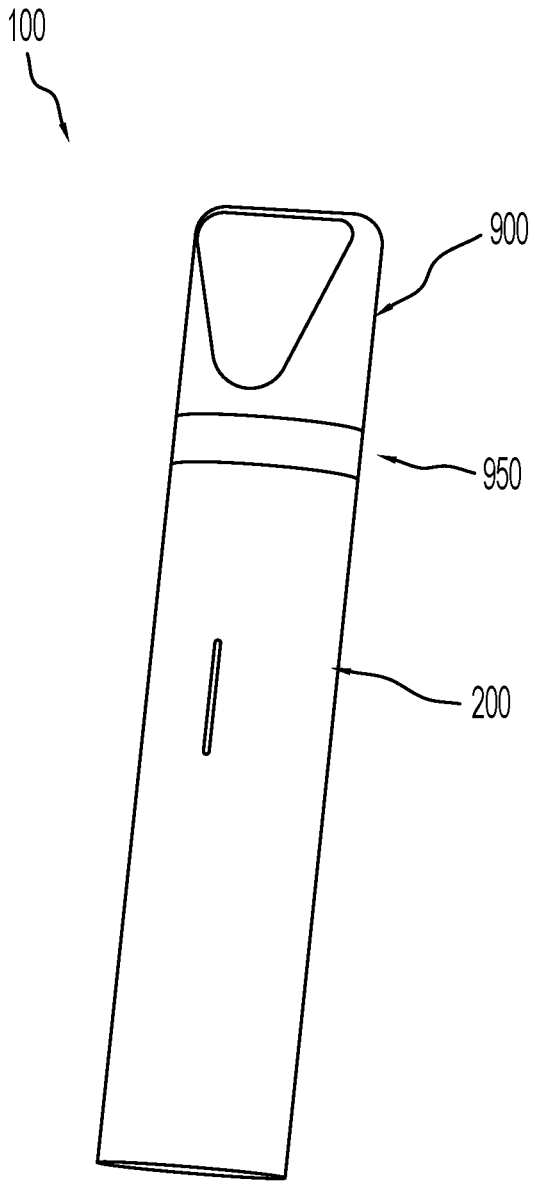
Figure 16:
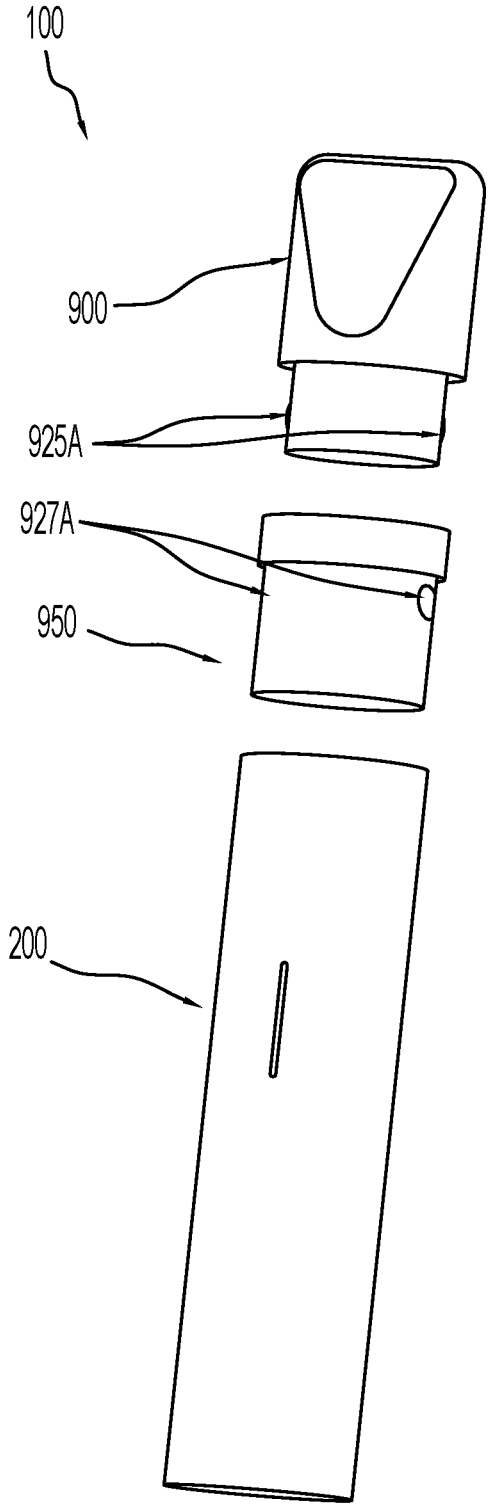
Figure 17:
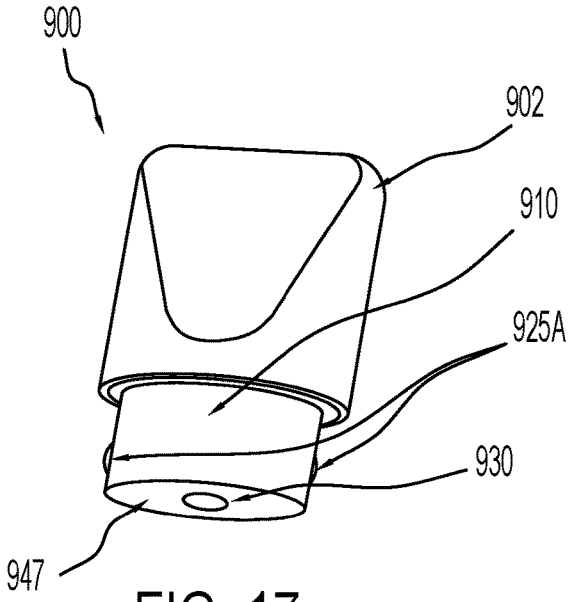
Figure 18:
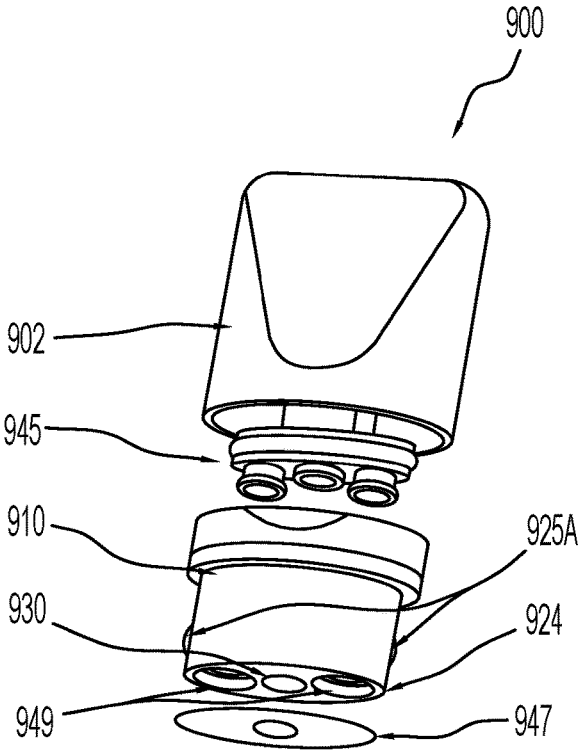
Figure 19:
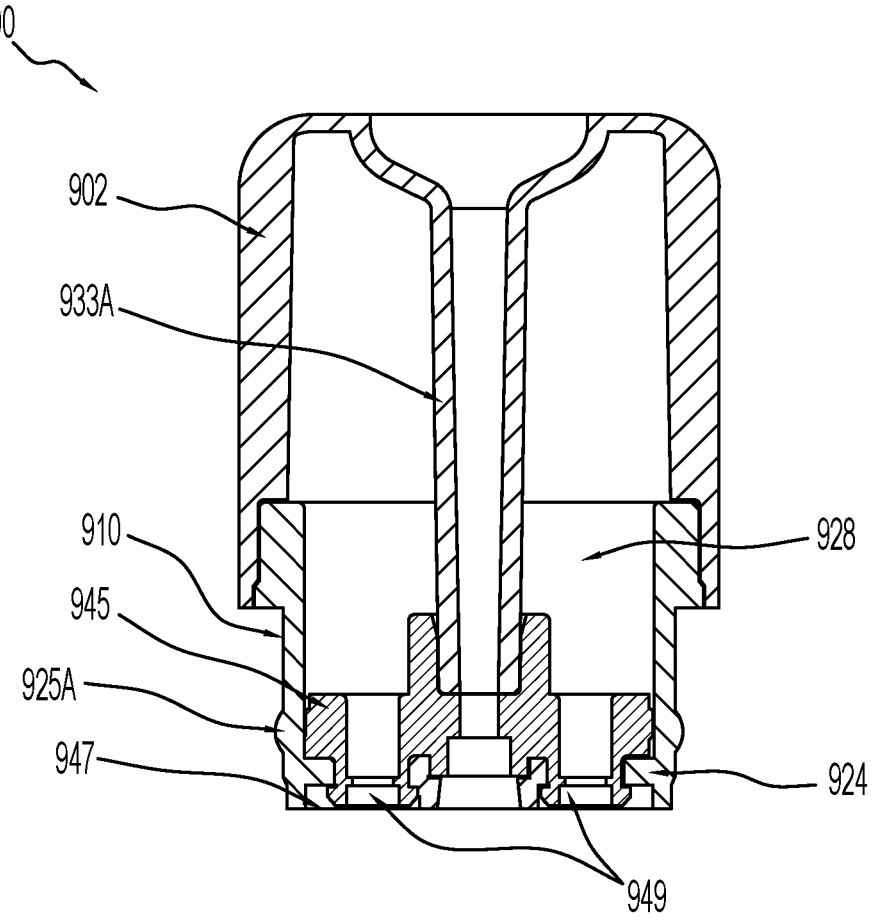
Figure 20:
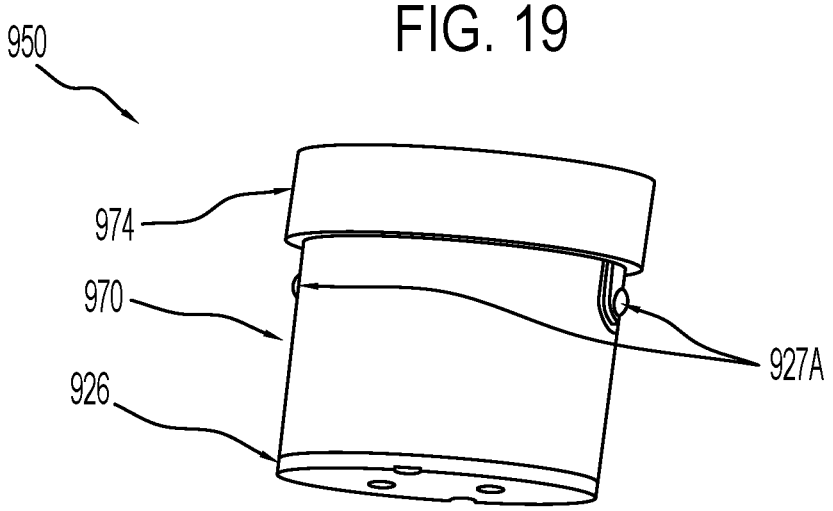
Figure 21:
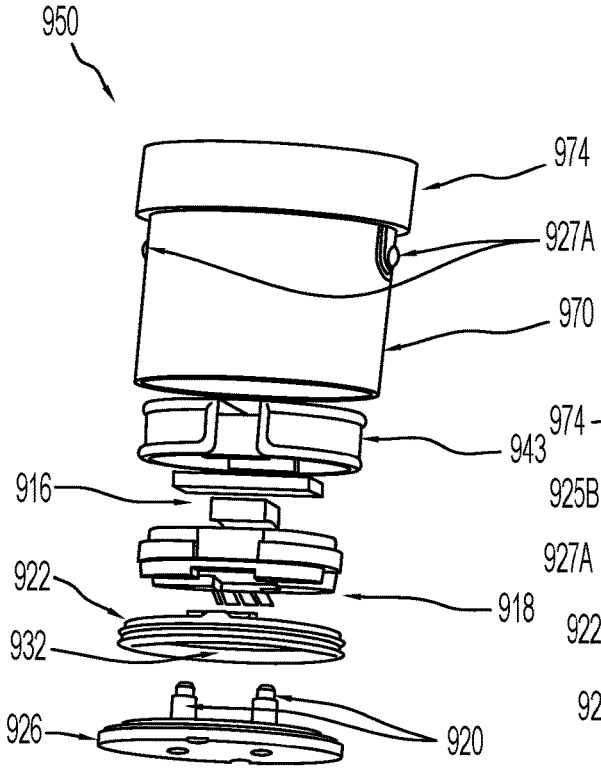
Figure 22:
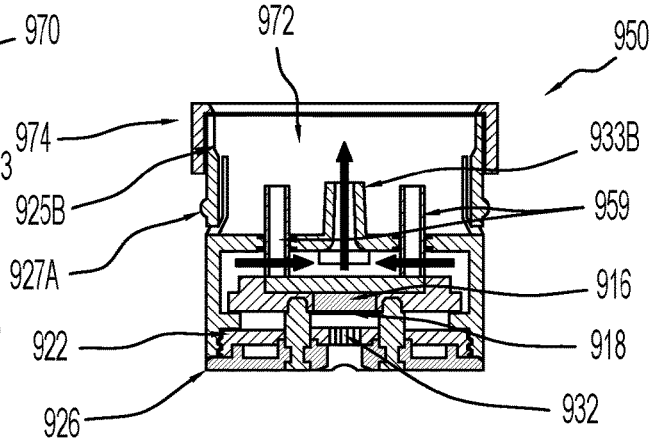
Figure 23:
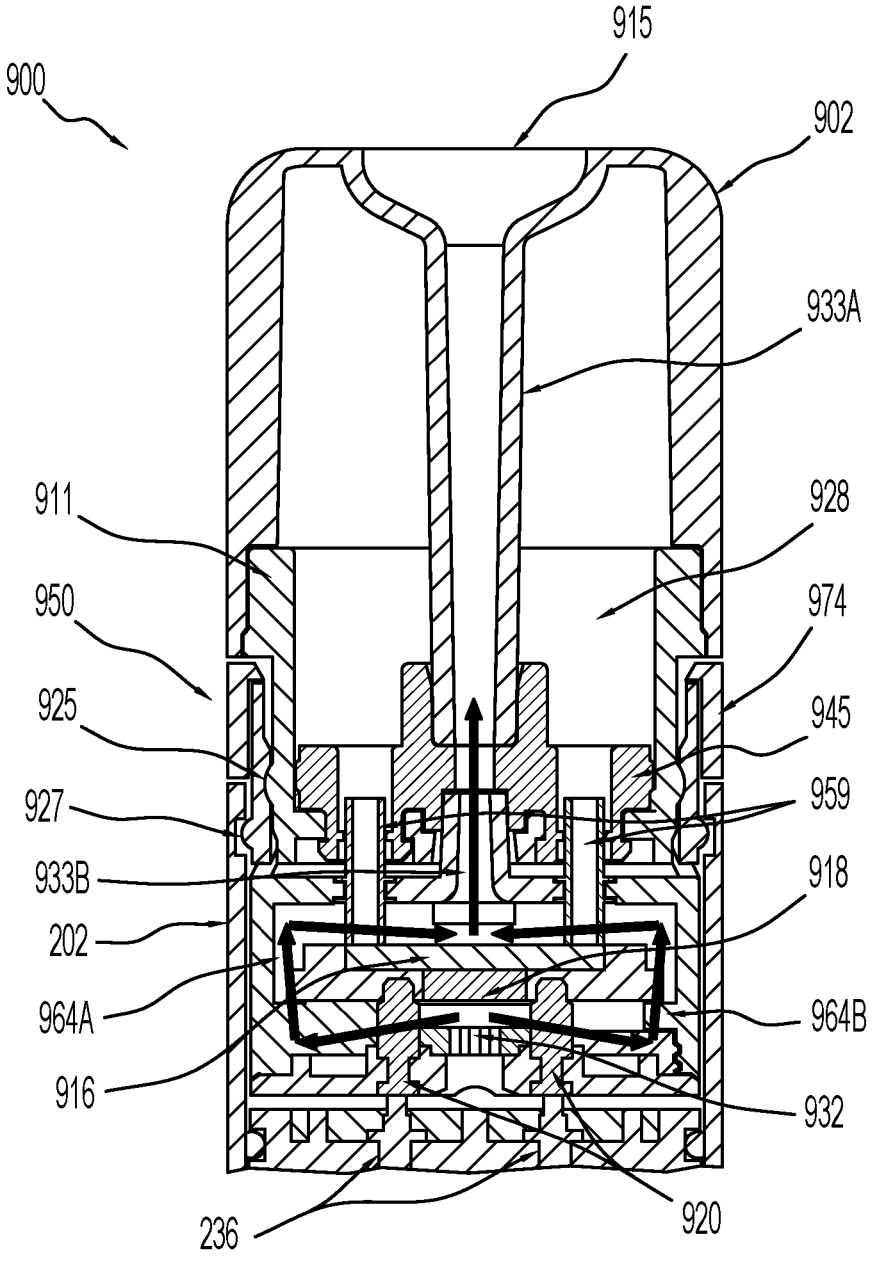
Figure 24:
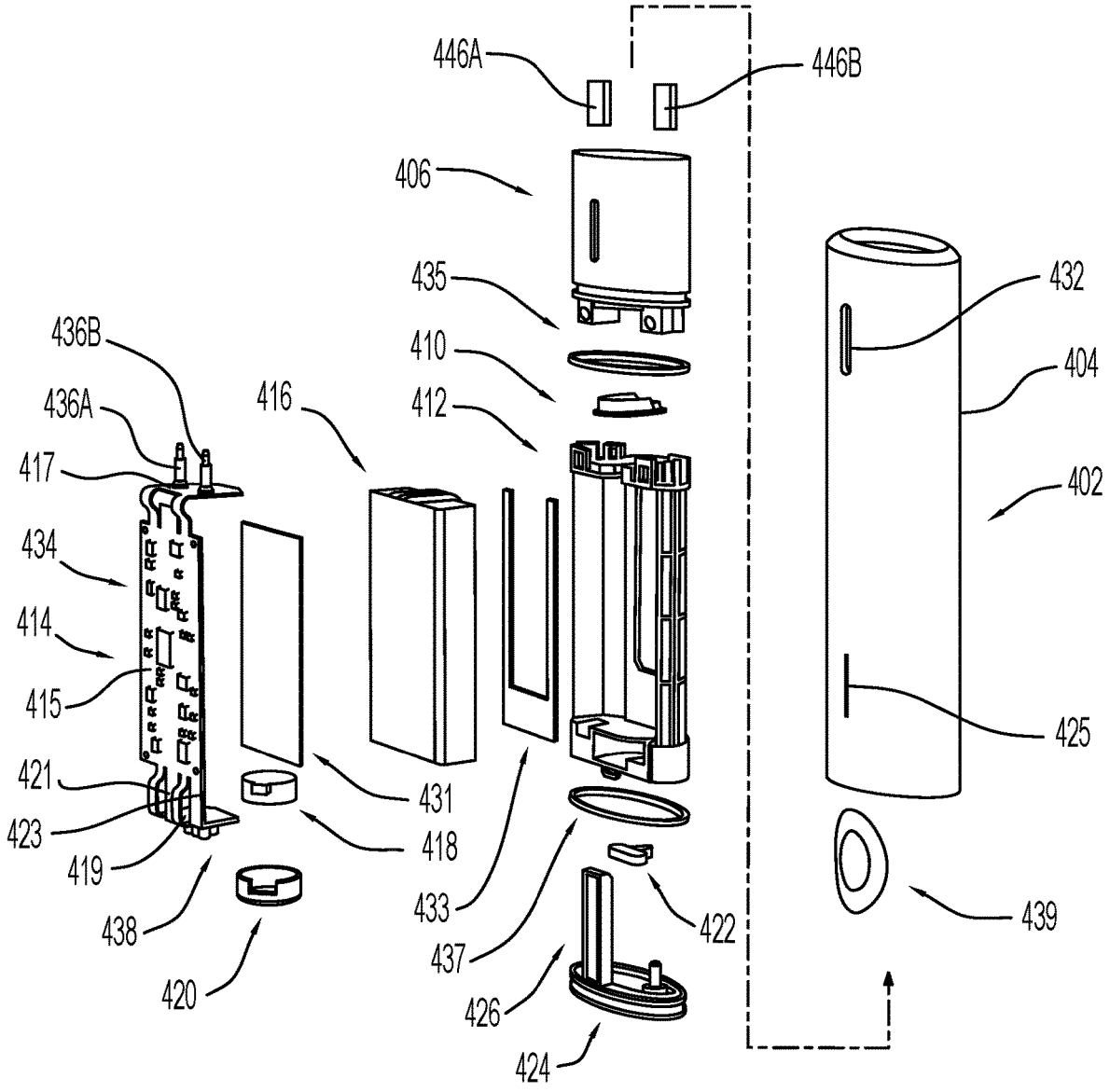
Figure 25:
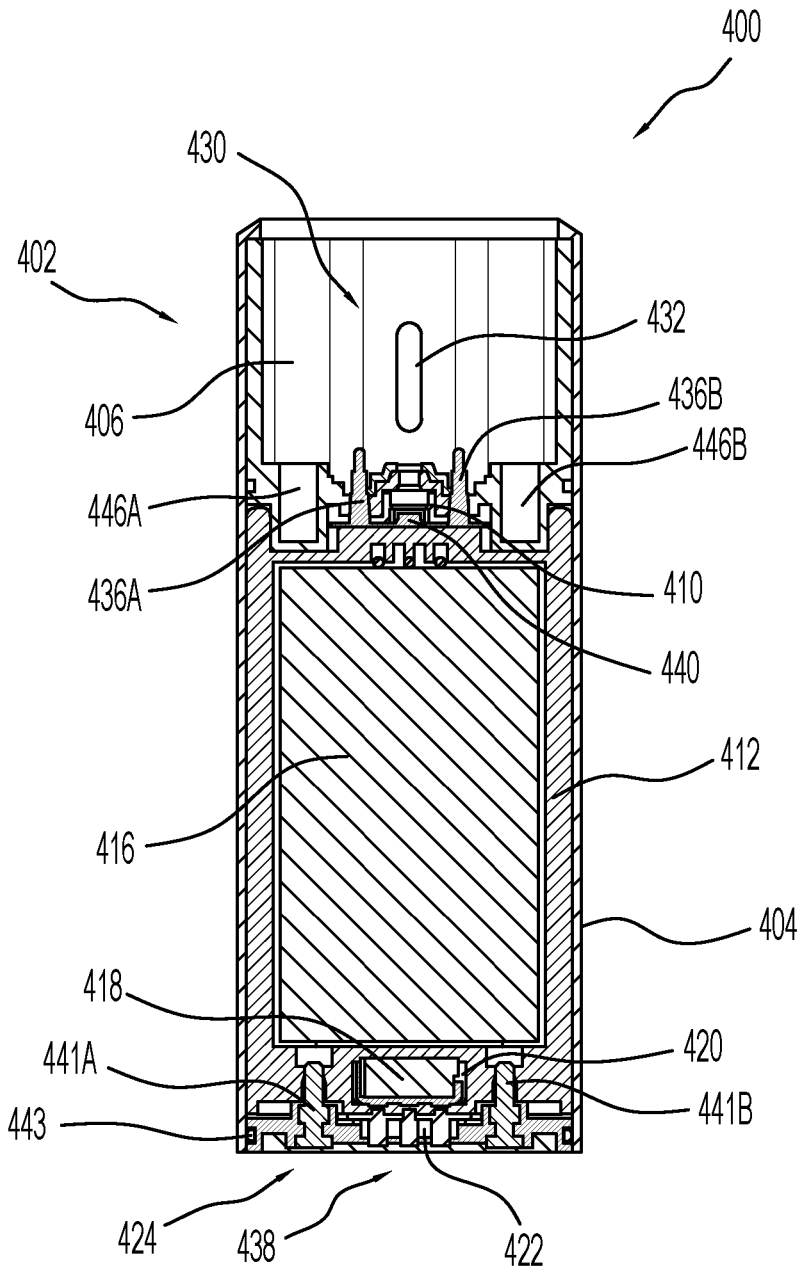
Figure 26:
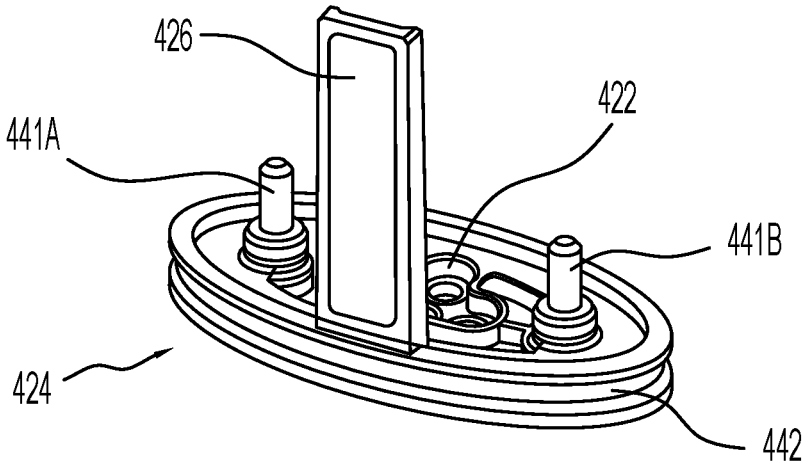
Figure 27A:
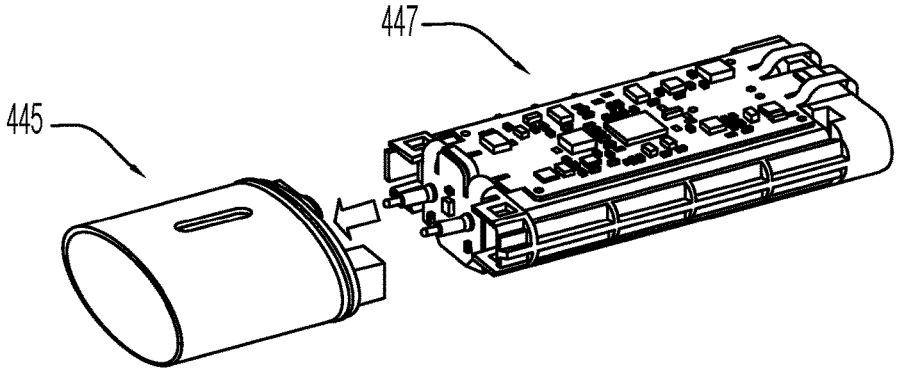
Figure 27B:
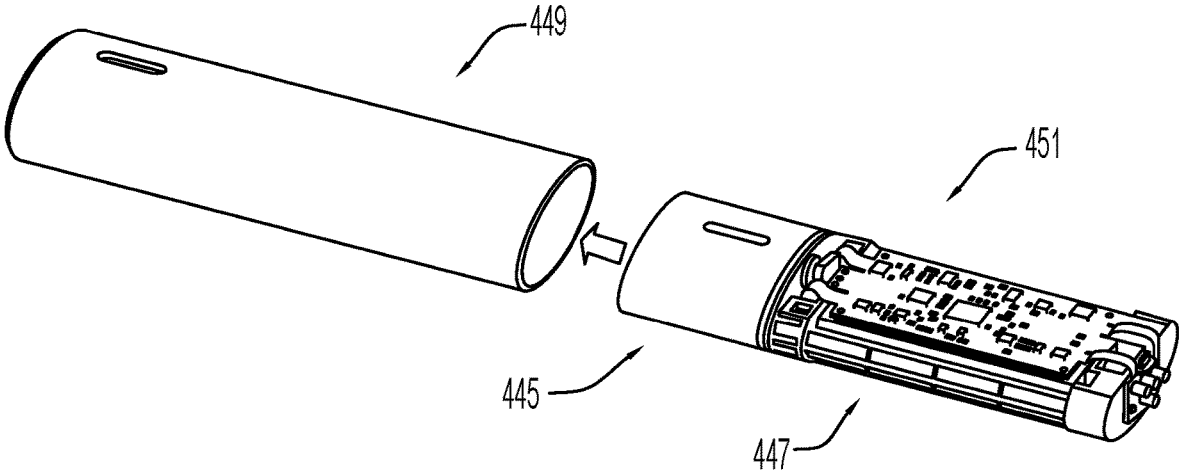
Figure 27C:
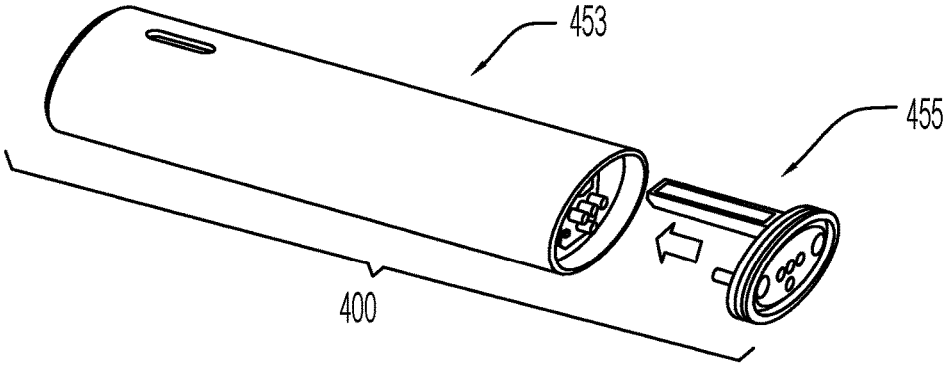
Figure 28A:
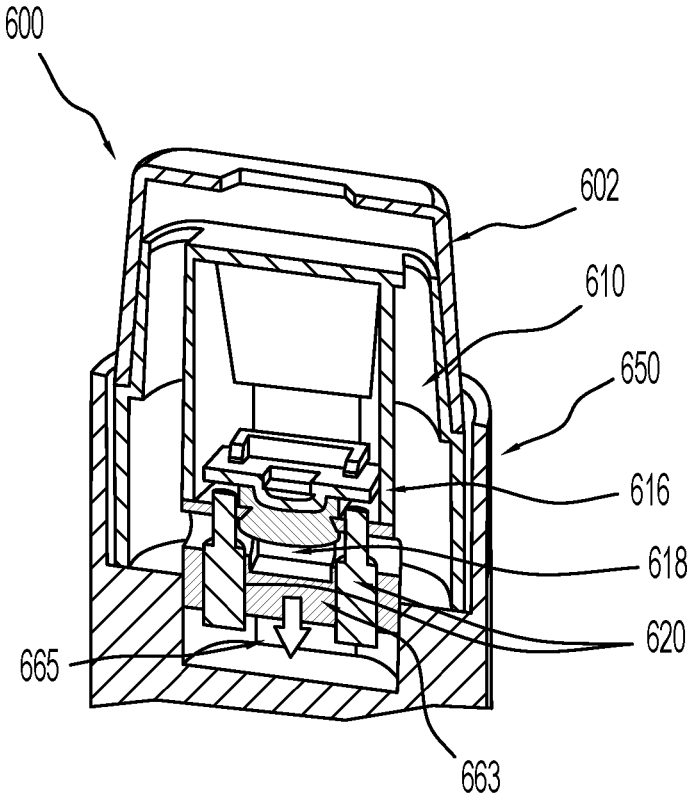
Figure 28B:
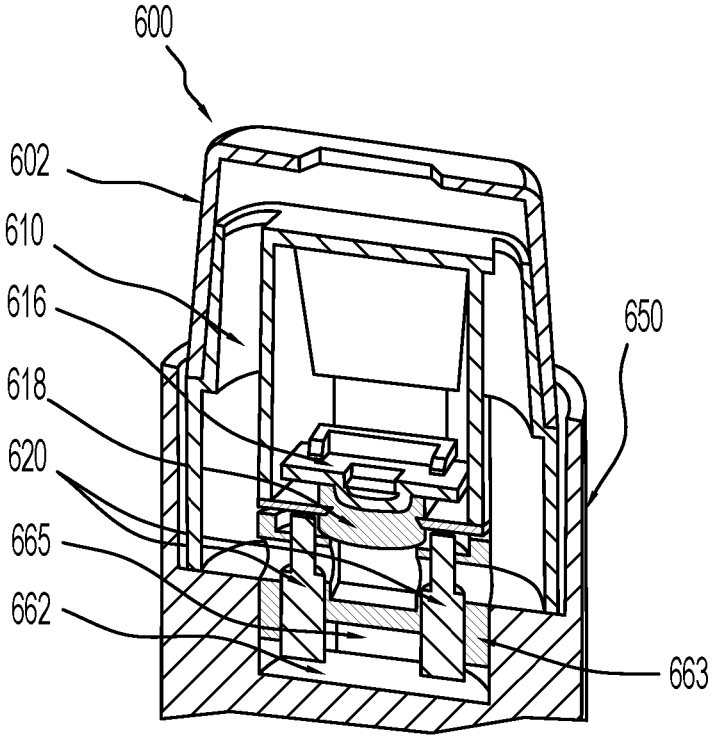

Having thus described the disclosure in the foregoing general terms, reference will now be made to the accompanying drawings, which are not necessarily drawn to scale, and wherein:

FIG. 1 illustrates a perspective view of a non-combustible aerosol provision system, according to an example implementations of the present disclosure;

FIG. 2 illustrates an exploded perspective view of the non-combustible aerosol provision system of FIG. 1, according to an example implementation of the present disclosure;

FIG. 3 illustrates a sectional front view of the non-combustible aerosol provision system of FIG. 1, according to example implementations of the present disclosure;

FIG. 4A illustrates an exploded, sectional front view of a consumable and aerosol generator of a non-combustible aerosol provision system, according to an example implementation of the present disclosure;

FIG. 4B illustrates an exploded, perspective view of the consumable of FIG. 4A, according to an example implementation of the present disclosure;

FIG. 5 illustrates a perspective view of a control device of a non-combustible aerosol provision system, according to example implementations of the present disclosure;

FIG. 6 illustrates an exploded perspective view of a control device of a non-combustible aerosol provision system, according to an example implementation of the present disclosure;

FIG. 7A illustrates a front view of a control device of a non-combustible aerosol provision system, according to an example implementation of the present disclosure;

FIG. 7B illustrates a corresponding section view of the control device of FIG. 7A, according to an example implementation of the present disclosure;

FIG. 8A illustrates a side view of a control device of a non-combustible aerosol provision system, according to an example implementation of the present disclosure;

FIG. 8B illustrates a corresponding section view of the control device of FIG. 8A, according to an example implementation of the present disclosure;

FIG. 9 illustrates a perspective partial section view of a control device of a non-combustible aerosol provision system, according to an example implementation of the present disclosure;

FIG. 10A illustrates an enlarged perspective view of a proximal end of a non-combustible aerosol provision system, according to an example implementation of the present disclosure;

FIG. 10B illustrates an exploded perspective view of the non-combustible aerosol provision system of FIG. 10A, according to an example implementation of the present disclosure;

FIG. 11 illustrates an enlarged, exploded sectional view of a proximal end of the non-combustible aerosol provision system of FIGS. 10A and 10B, according to an example implementation of the present disclosure;

FIGS. 12A and 12B illustrate a perspective view and an exploded perspective view, respectively, of a liquid transport element for use in a non-combustible aerosol provision system, according to an example implementation of the present disclosure;

FIG. 13 illustrates an enlarged, exploded partial sectional view of a proximal end of another non-combustible aerosol provision system, according to an example implementation of the present disclosure;

FIG. 14 illustrates an enlarged, exploded partial sectional view of a proximal end of yet another non-combustible aerosol provision system, according to an example implementation of the present disclosure;

FIG. 15 illustrates a perspective view of a non-combustible aerosol provision system, according to an example implementations of the present disclosure;

FIG. 16 illustrates an exploded perspective view of the non-combustible aerosol provision system of FIG. 15 according to an example implementation of the present disclosure;

FIG. 17 illustrates a perspective view of a consumable of a non-combustible aerosol provision system, according to an example implementations of the present disclosure;

FIG. 18 illustrates an exploded perspective view of the consumable of FIG. 17, according to an example implementation of the present disclosure;

FIG. 19 illustrates a sectional front view of the consumable of FIG. 17, according to example implementations of the present disclosure;

FIG. 20 illustrates a perspective view of an aerosol generator of a non-combustible aerosol provision system, according to an example implementations of the present disclosure;

FIG. 21 illustrates an exploded perspective view of the aerosol generator of FIG. 20, according to an example implementation of the present disclosure;

FIG. 22 illustrates a sectional front view of the aerosol generator of FIG. 20, according to example implementations of the present disclosure;

FIG. 23 illustrates a sectional front view of the consumable of FIG. 17 engaged with the aerosol generator of FIG. 20, according to example implementations of the present disclosure;

FIG. 24 illustrates an exploded perspective view of another control device of a non-combustible aerosol provision system, according to an example implementation of the present disclosure;

FIG. 25 illustrates a sectional front view of the control device of FIG. 24, according to an example implementation of the present disclosure;

FIG. 26 illustrates a perspective view of an endcap assembly, according to an example implementation of the present disclosure;

FIG. 27A illustrates subassemblies of the control device of FIG. 24, according to an example implementation;

FIG. 27B illustrates subassemblies of the control device of FIG. 24, according to an example implementation;

FIG. 27C illustrates subassemblies of the control device of FIG. 24, according to an example implementation; and FIGS. 28A and 28B illustrate sectional perspective views of a proximal end of a non-combustible aerosol provision system, according to an example implementation.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, the terms "data," "content," "digital content," "information," and similar terms may be at times used interchangeably. Additionally, where multiples of the same components are described, the multiples may be referred to individually (e.g., ##a, ##b, ##c, etc.) or collectively (##).

As described hereinafter, embodiments of the present disclosure relate to non-combustible aerosol provision systems, aerosol delivery devices, or vaporization devices, said terms being used herein interchangeably. Non-combustible aerosol provision systems according to the present disclosure use electrical energy to heat a material (preferably without combusting the material to any significant degree and/or without significant chemical alteration of the material) to form an inhalable substance; and components of such devices have the form of articles that most preferably are sufficiently compact to be considered hand-held devices.

That is, use of components of preferred non-combustible aerosol provision systems does not result in the production of smoke—i.e., from by-products of combustion or pyrolysis of tobacco, but rather, use of those preferred systems results in the production of vapors resulting from volatilization or vaporization of certain components incorporated therein. In preferred embodiments, components of non-combustible aerosol provision systems may be characterized as electronic cigarettes, and those electronic cigarettes most preferably incorporate tobacco and/or components derived from tobacco, and hence deliver tobacco derived components in aerosol form.

Non-combustible aerosol provision systems may provide many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe that is employed by lighting and burning tobacco (and hence inhaling tobacco smoke), without any substantial degree of combustion of any component thereof. For example, the user of an aerosol generating device of the present disclosure can hold and use that piece much like a smoker employs a traditional type of smoking article, draw on one end of that piece for inhalation of aerosol produced by that piece, take or draw puffs at selected intervals of time, and the like.

Non-combustible aerosol provision systems of the present disclosure also can be characterized as being vapor-producing articles or medicament delivery articles. Thus, such articles or devices can be adapted so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like.

Non-combustible aerosol provision systems of the present disclosure most preferably comprise some combination of a power source (i.e., an electrical power source), at least one control component (e.g., means for actuating, controlling, regulating and ceasing power for heat generation, such as by controlling electrical current flow from the power source to other components of the article—e.g., a microcontroller or microprocessor), a heater or heat generation member (e.g., an electrical resistance heating element or other component, which alone or in combination with one or more further elements may be commonly referred to as an "atomizer" or "vaporizer"), a substrate (e.g., an aerosol precursor composition liquid capable of yielding an aerosol upon application of sufficient heat, such as ingredients commonly referred to as "smoke juice," "e-liquid" and "e-juice"), and a mouthpiece or mouth region for allowing a user to draw upon the non-combustible aerosol provision system for aerosol inhalation (e.g., a defined airflow path through the article such that aerosol generated can be withdrawn therefrom upon draw).

In some implementations, the substrate material may comprise a liquid including an aerosol precursor composition and/or a gel including an aerosol precursor composition. Some examples of liquid compositions can be found in U.S. patent application Ser. No. 16/171,920, filed on Oct. 26, 2018, and titled Aerosol Delivery Device with Visible Indicator, which is incorporated herein by reference in its entirety.

As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, a substrate material may produce a visible aerosol upon the application of sufficient heat thereto (and cooling with air, if necessary), and the substrate material may produce an aerosol that is "smoke-like." In other aspects, the substrate material may produce an aerosol that is substantially non-visible but is recognized as present by other characteristics, such as flavor or texture. Thus, the nature of the produced aerosol may be variable depending upon the specific components of the aerosol delivery component. The substrate material may be chemically simple relative to the chemical nature of the smoke produced by burning tobacco.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally, or alternatively, include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)). It should be noted that the aerosol precursor composition may comprise any constituents, derivatives, or combinations of any of the above.

As noted herein, the aerosol precursor composition may comprise or be derived from one or more botanicals or constituents, derivatives, or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, ginkgo biloba, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca, Mentha piperita, Mentha piperita citrata* c.v., *Mentha piperita* c.v, *Mentha spicata crispa, Mentha cardifolia, Mentha longifolia, Mentha suaveolens variegata, Mentha pulegium, Mentha spicata* c.v. and *Mentha suaveolens.*

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the substrate material and/or those regions of the smoking article where an aerosol is generated. In some implementations, such agents may be supplied directly to a heating cavity or region proximate to the heat source or are provided with the substrate material. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

As used herein, the terms "flavor," "flavorant," "flavoring agents," etc. refer to materials which, where local regulations permit, may be used to create a desired taste, aroma, or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, ginkgo biloba, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some implementations, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some implementations, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

Flavoring agents may also include acidic or basic characteristics (e.g., organic acids, such as levulinic acid, succinic acid, pyruvic acid, and benzoic acid). In some implementations, flavoring agents may be combinable with the elements of the substrate material if desired. Example plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the substrate material. Organic acids particularly may be able to be incorporated into the substrate material to affect the flavor, sensation, or organoleptic properties of medicaments, such as nicotine, that may be able to be combined with the substrate material. For example, organic acids, such as levulinic acid, lactic acid, pyruvic acid, and benzoic acid may be included in the substrate material with nicotine in amounts up to being equimolar (based on total organic acid content) with the nicotine. Any combination of organic acids may be suitable. For example, in some implementations, the substrate material may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the substrate material. Various additional examples of organic acids employed to produce a substrate material are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In other implementations, the substrate material may include other materials having a variety of inherent characteristics or properties. For example, the substrate material may include a plasticized material or regenerated cellulose in the form of rayon. As another example, viscose (commercially available as VISIL), which is a regenerated cellulose product incorporating silica, may be suitable. Some carbon fibers may include at least 95 percent carbon or more. Similarly, natural cellulose fibers such as cotton may be suitable, and may be infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). Cotton may be treatable with, for example, boric acid or various organophosphate compounds to provide desirable flame-retardant properties by dipping, spraying or other techniques known in the art. These fibers may also be treatable (coated, infused, or both by, e.g., dipping, spraying, or vapor-deposition) with organic or metallic nanoparticles to confer the desired property of flame-retardancy without undesirable off-gassing or melting-type behavior.

More specific formats, configurations and arrangements of components within the non-combustible aerosol provision systems of the present disclosure will be evident in light of the further disclosure provided hereinafter. Additionally, the selection and arrangement of various non-combustible aerosol provision system components can be appreciated upon consideration of the commercially available electronic non-combustible aerosol provision systems, such as those representative products referenced in the background art section of the present disclosure.

In various implementations, the present disclosure relates to non-combustible aerosol provision systems, aerosol generators, consumables, and control devices that together comprise a non-combustible aerosol provision system. As will be described in more detail below, in various implementations the non-combustible aerosol provision system may have improved connectively, airflow, and/or aerosol paths through the device.

An example implementation of a non-combustible aerosol provision system 100 of the present disclosure is shown in FIGS. 1-3. As illustrated, the non-combustible aerosol provision system 100 includes a control device 200, an aerosol generator 350, and a removable consumable 300. Although only one aerosol generator and only one consumable are shown in the depicted implementation, it should be understood that, in various implementations, the non-combustible aerosol provision system 100 may comprise an interchangeable system. For example, in one or more implementations, a single control device may be usable with a plurality of different aerosol generators and/or consumables. Likewise, in one or more implementations, a single consumable may be usable with a plurality of different control devices and/or aerosol generators.

Specifically, FIG. 1 illustrates a perspective view of the system, FIG. 2 illustrates an exploded perspective view of the system 100, and FIG. 3 illustrates a sectional front view of the system 100. As shown in the figures, the control device 200 includes a power source 216, the aerosol generator 350 is removably coupled with the control device 200 so as to receive power from the power source 216 and generate an aerosol from a substrate located within the consumable 300. The consumable 300 is removably coupled to one or both of the aerosol generator 350 and the control device 200. The consumable 300 includes a storage compartment 310 configured to contain the substrate, which the consumable is configured to supply to the aerosol generator 350. The control device 200 is described in greater detail with respect to FIGS. 5-9. The aerosol generator 350 is described in greater detail with respect to FIGS. 4A, 11, 13, 14, and 20-22 and the consumable 300 is described in greater detail with respect to FIGS. 4A, 4B, 11-14, and 17-19.

Referring back to FIGS. 1-3, the control device 200 includes an outer housing defining a proximal end 200A and a distal end 200B, where the proximal end of the control device defines a chamber 230 or cavity configured to at least partially receive the aerosol generator 350 and/or the consumable 300. The distal end 200B includes an end cap 224 that includes a port and circuitry for recharging the power source 216. In the depicted implementation, the aerosol generator 350 is substantially to completely received within the chamber 230. Generally, the aerosol generator 350 includes a vaporizer 318, a liquid transport element 316, and an electrical connection for coupling the vaporizer to the power source. The aerosol generator also defines a vaporization chamber 332. The consumable 300 may include a mouthpiece 302 coupled to a proximal end of the consumable 300 that is configured to engage with a user's mouth. The consumable storage compartment 310 is configured to hold the substrate and the distal end of the consumable 300 is configured to engage a with the aerosol generator 350 so as to present the substrate to the vaporizer.

In various implementations, the term vaporizer is intended to encompass any component that is effective to convert a liquid, gel, or semi-solid substrate into a vapor suitable for mixing with air to form an aerosol, and may include, for example, resistance heaters, induction heaters, radiant heaters, ceramic heaters, thick-film heaters, piezoelectric vaporizers, jet nebulizers, ultrasonic wave nebulizers, vibrating mesh technology (VMT) nebulizers, surface acoustic wave (SAW) nebulizers, ultrasonic vaporizers, and the like. Resistance type heaters may include heating elements in the form of, for example, wire coils or ribbons, flat plates, prongs, micro-heaters, filaments, sintered metal fibers, flat heaters, metal traces FIG. 4A illustrates an exploded sectional view of the consumable 300 and the aerosol generator 350. FIG. 4B illustrates an exploded perspective view of the consumable 300. Although other configurations are possible, the consumable 300 of the depicted implementation generally includes the mouthpiece 302, a mouthpiece insert 304, the storage compartment 310 (also referred to herein as a tank or a reservoir) defined by a storage compartment wall 311, and a base member 314 that may include an interface or portal 308 for engaging the aerosol generator and a recess 317 configured to at least partially receive the aerosol generator 350. The aerosol generator 350 generally includes the liquid transport element (e.g., a wick) 316, the heating member 318, a pair of heater connectors 320A, 320B, a seal 322 to prevent leakage from between the consumable and aerosol generator interface, a bottom cap 326, and a latching mechanism 325 for engaging the control device 200. Variations of the arrangement of these components is illustrated in FIGS. 11-23.

As shown in the figures, the mouthpiece 302 of the depicted implementation defines a proximal end and a distal end, with the proximal end of the mouthpiece 302 defining an exit portal 315 therein. In the depicted implementation, the mouthpiece insert 304 is configured to be located proximate the proximal end of the mouthpiece 302 such that it extends through the exit portal 315 thereof. In the depicted implementation, the mouthpiece 302 and the mouthpiece insert 304 may be made of a molded polymer material, such as, for example, a molded plastic material (e.g., polypropylene, acrylonitrile butadiene styrene (ABS), polyethylene, polycarbonate, Polyamide (Nylon), high impact polystyrene, and combinations thereof), although other materials are possible. The mouthpiece insert 304 of the depicted implementation includes a flange feature on a lower portion thereof such that the mouthpiece insert 304 may be installed from inside the mouthpiece 302 and may be configured for a press or snap-fit connection with the exit portal 315. In other implementations, other attachment methods are possible (e.g., via adhesives, heat staking/welding, ultrasonic welding, etc.). In still other implementations, the mouthpiece and mouthpiece insert may be constructed using an insert molding or over-molding process such that the mouthpiece 302 and the mouthpiece insert 304 comprise a unitary part. The mouthpiece 302 of the depicted implementation is configured to be secured to the storage compartment 310 via snap features 323 included on one or both of the mouthpiece 302 and the storage compartment 310; however, other attachment methods are possible (e.g., via adhesives, heat staking/welding, ultrasonic welding, etc.).

Although other configurations are possible, in the depicted implementation, the consumable 300 further includes an upper aerosol channel insert 306 configured to absorb liquid formed by deposition and/or condensation from aerosol formed in the vaporization chamber 332, and is configured to have rigid or semi-rigid properties. As such, the upper aerosol channel insert 306 of the depicted implementation may be made of a fibrous, sintered beaded, or open cell foam material. In such a manner, the upper aerosol channel insert 306 may be configured for a press or snap fit attachment with the mouthpiece 302. The upper aerosol channel insert 306 is also configured to help to prevent accumulation of liquid from exiting the consumable 300 through the mouthpiece 302. In addition, the upper aerosol channel insert 306 is located in such a way that aerosol produced in the vaporization chamber 332 passes through the insert 306 just prior to exiting the consumable 300. In the depicted implementation, the inside cavity of the upper aerosol channel insert 306 may also serve as a cooling chamber within which the formed aerosol can be allowed to expand and/or cool before passing through the exit portal 315. In some implementations, the vaporization chamber 332 and the cooling chamber may be configured to have a defined relative volume ratio.

In some implementations, the mouthpiece insert may exhibit a color associated with a distinctive characteristic of the consumable. For example, in some implementations a consumable of the present disclosure may include a liquid composition that includes a distinctive characteristic such as, for example, a particular flavorant (as discussed infra), or a specific strength of nicotine, although any characteristic of the consumable may be considered a distinctive characteristic. For the purposes of the current description, the term "color" should be interpreted broadly, for example covering any color or any shade of the same color. It should also be noted that in some implementations, certain colors may be commonly associated with particular distinctive characteristics (e.g., the color green may be associated with a mint flavorant, and the color red may be associated with an apple flavorant); however, in other implementations, certain colors may be associated with particular distinctive characteristics according to an index or guide, which may be provided or made available to a user. Examples of distinctive characteristics are described in U.S. patent application Ser. No. 16/171,920, titled Aerosol Delivery Device with Visible Indicator, which is incorporated herein by reference in its entirety.

The storage compartment 310 of the depicted implementation defines a proximal end and a distal end, wherein the mouthpiece 302 is configured to engage the proximal end of the storage compartment 310 and the bottom cap 326 of the aerosol generator is configured to engage the distal end of the storage compartment 310. In some implementations, the distal end of the storage compartment defines the portal 308, or at least a portion thereof, for presenting the substrate to the aerosol generator. In the depicted implementation, the storage compartment 310 also defines a reservoir cavity 328 that includes a closed proximal end and an open distal end. As such, the reservoir cavity 328 of the storage compartment 310 is configured to contain a liquid composition (e.g., an e-liquid or aerosol precursor composition) therein. The closed proximal end of the reservoir cavity 328 allows the cavity to create a reliable seal on the top side of the liquid composition column. This may prevent the seepage/entry of air into the reservoir cavity from the top end when the consumable is held upright. This may also prevent air from entering from the top of the liquid composition column, which may create a vacuum and may reduce the potential of the liquid composition to leak from the bottom of the storage compartment through the liquid transport element or other passages.

Although other configurations are possible, in the depicted implementation a pair of internal aerosol flow tubes 333A, 333B are defined on opposite sides of the reservoir cavity 328 of the storage compartment 310. In the case of an injection molded storage compartment 310, the internal aerosol flow tubes 333A, 333B are configured to be molded therein. As will be described in more detail below, aerosol produced in a vaporization chamber 332 of the aerosol generator 350 is configured to travel through the aerosol flow tubes 333A, 333B for delivery to a user. The flow paths 333 may be oriented symmetrically through the consumable 300 and merge before exiting the portal 315.

In the depicted implementation, the storage compartment wall 311 is configured to be transparent or translucent so that the liquid composition contained therein may be visible externally. As such, in the depicted implementation, the entire storage compartment wall 311 is configured to be transparent or translucent. Alternatively, in some implementations, only a portion of the storage compartment wall or only a single side of the storage compartment wall may be transparent or translucent while the remaining portions of the storage compartment wall may be substantially opaque. In other implementations, the storage compartment wall may be substantially opaque, and a strip extending from the proximal end of the storage compartment to the distal end of the storage compartment may be transparent or translucent.

In further implementations, the storage compartment wall may be colored. In some implementations, the color can be configured so that the liquid composition within the storage compartment is still visible, such by using a transparent or translucent outer storage compartment wall. In other implementations, the storage compartment wall can be configured so that the outer storage compartment wall has a substantially opaque color. In the depicted implementation, the storage compartment 310 may be made of a molded polymer material, such as, for example, a molded plastic material (e.g., a copolyester material, such as, for example, Tritan™ copolyester, acrylonitrile butadiene styrene (ABS), polyethylene, polycarbonate, Polyamide (Nylon), high impact polystyrene, polypropylene, and combinations thereof), although other materials, including glass, are possible.

In certain implementations, at least a portion of the storage compartment 310 may be visible when the consumable 300 is engaged with the control device 200 and/or the aerosol generator 350. As noted above, in some implementations at least a portion of the storage compartment wall 311 may be configured to be at least partially transparent or translucent so that the liquid composition contained therein is visible externally. Thus, the relative amount of any liquid composition present in the storage compartment 310 may be visible through an indication window when the consumable 300 engaged with the control device 200 and/or the aerosol generator 350.

Referring back to FIG. 4A, the liquid transport element 316 of the aerosol generator 350 is disposed within the vaporization chamber 332 and in fluid communication with the substrate (i.e., liquid composition held in the reservoir 328) via a rigid or semi-rigid fluid delivery channel 309 configured to engage the storage compartment 310 via the interface/portal 308. The fluid delivery channel may be a tube, a cannula, or a similar device. In the depicted implementation, the interface/portal 308 is an elastomeric split valve, for example, a split septum or similar, through which the fluid delivery channel 309 sealingly passes. The size, shape, and material of the fluid delivery channel may vary to suit a particular application. The base or bottom surface 314 of the consumable 300/storage compartment 310 includes a recess 317 configured to sealingly engage with the aerosol generator 350 via the seal 322 and a raised portion of the vaporization chamber 332. Once engaged, the liquid composition from the reservoir travels through the fluid delivery channel 309 and into the liquid transport element 316 for vaporization by the heater 318.

The aerosol generator 350 further includes the pair of heater contacts 320 for electrically coupling the heater 318 to the power source when coupled to the control device. The aerosol generator 350 is coupled to the control device via the latching mechanism 325 coupled to the base member 326 and comprising a pair of retention snaps 327 that engage a mating structure disposed within the receiving chamber (see, for example, FIG. 9). The retention snaps 327 flex inwardly for insertion within the receiving chamber 230. In some implementations, the aerosol generator 350 may be removable via, for example, a force sufficient disengage the retention snaps from their mating structure, squeezing the device, and/or an external actuator.

The heater contacts 320 extend at least partially through the base 326 and latching mechanism 325 so as to be engageable with mating electrical contacts disposed within the receiving chamber 230 to complete the electrical circuit. The base 326 includes an air inlet channel 330, which is located in an approximate center of a bottom surface of the bottom cap 326. Although other configurations are possible, in the depicted implementation the air inlet channel 330 has a nozzle-like shape. In particular, the air inlet channel 330 of the depicted implementation includes a first portion (proximate the bottom surface of the bottom cap 326), which has a substantially cylindrical shape and a second portion, which has a substantially conical shape and leads to the vaporization chamber 332. In such a manner, the internal diameter of the consumable air inlet channel 330 decreases before leading to the vaporization chamber 332. This configuration may help to keep the air inlet channel 330 relatively clear of liquid build-up leading into the vaporization chamber 332. The latching mechanism may include a clearance hole to prevent blockage of the air inlet channel 330.

FIG. 5 illustrates a perspective view of one implementation of a control device 200, and FIG. 6 illustrates an exploded perspective view of the one implementation of the control device 200. As shown in the figures, the control device 200 of the depicted implementation generally includes a housing 202 defining an outer wall 204, an upper frame 206, an upper frame seal 208, a pressure sensor seal 210, a lower frame 212, a control component 214, a battery 216, a vibration motor 218, a motor housing 220, a pin seal 222, an end cap 224, and a light diffuser 226. The arrangement of these components is illustrated in FIGS. 7A and 7B, and FIGS. 8A and 8B. In particular, FIG. 7A illustrates a front view of the control device 200, and FIG. 7B illustrates a corresponding section view of the control device 200. Likewise, FIG. 8A illustrates a side view of the control device 200, and FIG. 8B illustrates a corresponding section view of the control device 200. As illustrated in the figures, the upper frame 206 of the control device 200 defines a receiving chamber 230 within which an aerosol generator and/or a consumable may be coupled. The control device 200 also includes a pair of opposite indication windows 232 that are defined through the outer wall 204 of the housing 202, as well as through the upper frame 206. As will be described in more detail below, in various implementations the indication windows 232 may provide a user with the ability to view one or more components (and/or conditions thereof) of an installed consumable. It will be appreciated, however, that the illustrated indication windows 232 are provided by way of example and not by way of limitation. For example, alternative implementations may include an indication window having a different shape than that illustrated. As another example, some implementations may include only a single indication window. In still other implementations, there need not be any indication windows. In the depicted implementation, the upper frame 206 and the housing 202 represent different parts; however, in other implementations, the upper frame and the housing may be continuously formed such that they comprise the same part.

In the depicted implementation, the housing 202 comprises a metal material, such as, for example, aluminum; however, in other implementations the housing may comprise a metal alloy material, and in still other implementations the housing may comprise a molded plastic material. In the depicted implementation, one or more of the housing 202, upper frame 206, lower frame 212, and end cap 224 may be made of a molded polymer material, such as, for example, a molded plastic material (e.g., polybutylene terephthalate (PBT), acrylonitrile butadiene styrene (ABS), polyethylene, polycarbonate, Polyamide (Nylon), high impact polystyrene, polypropylene, and combinations thereof). In other implementations, one or more of these components may be made of other materials, including, for example, metal materials (e.g., aluminum, stainless steel, metal alloys, etc.), glass materials, ceramic materials (e.g., alumina, silica, mullite, silicon carbide, silicon nitride, aluminum nitride, etc.), composite materials, and/or any combinations thereof.

In the depicted implementation, the lower frame 212 is configured to contain the battery 216 in an interior area thereof. In the depicted implementation, the battery may comprise a lithium polymer (LiPo) battery; however various other batteries may be suitable. Some other examples of batteries that can be used according to the disclosure are described in U.S. Pat. App. Pub. No. 2010/0028766 to Peckerar et al., the disclosure of which is incorporated herein by reference in its entirety. In some implementations, other types of power sources may be utilized. For example, in various implementations a power source may comprise a replaceable battery or a rechargeable battery, solid-state battery, thin-film solid-state battery, rechargeable super-capacitor or the like, and thus may be combined with any type of recharging technology, including connection to a wall charger, connection to a car charger (e.g., cigarette lighter receptacle, USB port, etc.), connection to a computer, such as through a universal serial bus (USB) cable or connector (e.g., USB 2.0, 3.0, 3.1, USB Type-C), connection to a USB connector (e.g., USB 2.0, 3.0, 3.1, USB Type-C as may be implemented in a wall outlet, electronic device, vehicle, etc.), connection to a photovoltaic cell (sometimes referred to as a solar cell) or solar panel of solar cells, a wireless charger, such as a charger that uses inductive wireless charging (including for example, wireless charging according to the Qi wireless charging standard from the Wireless Power Consortium (WPC)), or a wireless radio frequency (RF) based charger, and connection to an array of external cell(s) such as a power bank to charge a device via a USB connector or a wireless charger. An example of an inductive wireless charging system is described in U.S. Pat. App. Pub. No. 2017/011216 to Sur et al., which is incorporated herein by reference in its entirety. In further implementations, a power source may also comprise a capacitor. Capacitors are capable of discharging more quickly than batteries and can be charged between puffs, allowing the battery to discharge into the capacitor at a lower rate than if it were used to power the heating member directly. For example, a super-capacitor—e.g., an electric double-layer capacitor (EDLC)—may be used separate from or in combination with a battery. When used alone, the super-capacitor may be recharged before each use of the article. Thus, the device may also include a charger component that can be attached to the smoking article between uses to replenish the super-capacitor. Examples of power supplies that include super-capacitors are described in U.S. Pat. App. Pub. No. 2017/0011211 to Sur et al., which is incorporated herein by reference in its entirety.

The non-combustible aerosol provision system 100 of the depicted implementation includes a control mechanism in the form of the control component 214, which is configured, in part, to control the amount of electrical power provided to the heating member of the aerosol generator. Although other configurations are possible, the control component 214 of the depicted implementation comprises a circuit board 234 (e.g., a printed circuit board (PCB)) that includes both rigid and flexible portions. In particular, the circuit board 234 of the depicted implementation includes a rigid central section 215 and two rigid end sections comprising a proximal end section 217 and a distal end section 21, with each of the end sections 217, 219 being connected to the central section 215 by a respective flexible connection. In such a manner, when the lower frame 212, battery 216, and circuit board 234 are assembled into the control device 200, the central section 215 of the circuit board 234 is configured to be disposed proximate a major surface of the battery 216, and the two end sections 217, 219 are configured to be disposed substantially perpendicular to the central section 215. In particular, the proximal end section 217 of the circuit board 234 is configured to extend over the top of the lower frame 212, and the distal end section 219 is configured to extend over the bottom of the lower frame 212. The lower frame 212 of the control device 200 may also be configured to contain a motor housing 220, into which a vibration motor 218 may be received. In various implementations, the vibration motor 218 may provide haptic feedback relating to various operations of the device 100.

The central section 215 of the depicted implementation also includes an indicator in the form of a light source 221. In some implementations, the light source may comprise, for example, at least one light emitting diode (LED) capable of providing one or more colors of light. In other implementations, the light source may be configured to illuminate in only one color, while in other implementations, the light source may be configured to illuminate in variety of different colors. In still other implementations, the light source may be configured to provide white light. In the depicted implementation, the light source 221 comprises an RGB (red, green, blue) LED that is configured to provide a variety of colors of light, including white light. The central section 215 of the depicted circuit board 234 also includes electrical contacts 223 that are configured to operatively connect the circuit board 234 to the vibration motor 218. Other types of electronic components, structures and configurations thereof, features thereof, and general methods of operation thereof, are described in U.S. Pat. No. 4,735,217 to Gerth et al.; U.S. Pat. No. 4,947,874 to Brooks et al.; U.S. Pat. No. 5,372,148 to McCafferty et al.; U.S. Pat. No. 6,040,560 to Fleischhauer et al.; U.S. Pat. No. 7,040,314 to Nguyen et al. and U.S. Pat. No. 8,205,622 to Pan; U.S. Pat. App. Pub. Nos. 2009/0230117 to Fernando et al., 2014/0060554 to Collet et al., and 2014/0270727 to Ampolini et al.; and U.S. Pat. App. Pub. No. 2015/0257445 to Henry et al.; which are incorporated herein by reference. Yet other features, controls or components that can be incorporated into non-combustible aerosol provision systems of the present disclosure are described in U.S. Pat. No. 5,967,148 to Harris et al.; U.S. Pat. No. 5,934,289 to Watkins et al.; U.S. Pat. No. 5,954,979 to Counts et al.; U.S. Pat. No. 6,040,560 to Fleischhauer et al.; U.S. Pat. No. 8,365,742 to Hon; U.S. Pat. No. 8,402,976 to Fernando et al.; U.S. Pat. App. Pub. Nos. 2010/0163063 to Fernando et al.; 2013/0012623 to Tucker et al.; 2013/0298905 to Leven et al.; 2013/0180553 to Kim et al., 2014/0000638 to Sebastian et al., 2014/0261495 to Novak et al., and 2014/0261408 to DePiano et al.; which are incorporated herein by reference in their entireties.

In the depicted implementation, the light source 221 is covered by the light diffuser 226, a portion of which is configured to be received by the end cap 224. In such a manner, when assembled, the light diffuser 226 is positioned in or proximate an aperture 225 defined in the outer wall 204 of the housing 202 and proximate a distal end thereof. In the depicted implementation, the aperture 225 comprises a narrow, elongate opening; however, in other implementations, the aperture may be provided in any desired shape and may be positioned at any location on the control device 200. In some implementations, the light diffuser 226 may comprise a transparent or translucent member configured to allow a user to view the light source 221 from the outside of the housing 202. In the depicted implementation, the light diffuser 226 may be made of a molded polymer material, such as, for example, a molded plastic material (e.g., acrylonitrile butadiene styrene (ABS), polyethylene, polycarbonate, Polyamide (Nylon), high impact polystyrene, polypropylene, and combinations thereof), although other materials, including glass, are possible. In various implementations, further indicators (e.g., other haptic feedback components, an audio feedback component, or the like) can be included in addition to or as an alternative to the indicators included in the depicted implementation. Additional representative types of components that yield visual cues or indicators, such as LED components, and the configurations and uses thereof, are described in U.S. Pat. No. 5,154,12 to Sprinkel et al.; U.S. Pat. No. 8,499,766 to Newton and U.S. Pat. No. 8,539,959 to Scatterday; U.S. Pat. App. Pub. No. 2015/0020825 to Galloway et al.; and U.S. Pat. App. Pub. No. 2015/0216233 to Sears et al.; which are incorporated herein by reference in their entireties.

Although other configurations are possible, the proximal end section 217 of the circuit board 234 of the depicted implementation includes a pair of conductive pins 236A, 236B, as well as a pressure sensor 240. In the depicted implementation, the conductive pins 236A, 236B comprise spring-loaded pins (e.g., electrical pogo pins) that extend through the upper frame 206 such that portions of the ends of the pins 236A, 236B extend into the receiving chamber 230 and are biased in that position due to the force of the internal springs of the conductive pins 236A, 236B. In such a manner, when an aerosol generator is coupled with the control device 200, the conductive pins 236A, 236B are configured to contact corresponding features (e.g., heater contacts 320) of the aerosol generator (with or without a consumable) and deflect downward (e.g., toward the lower frame 212) against the force of the springs, thus operatively connecting the installed aerosol generator with the control component 214 and the battery 216. In the depicted implementation, the conductive pins 236A, 236B comprise gold plated metal pins; however, other materials or combinations of materials, which may also include coatings and/or platings of electrically conductive materials, are possible. Examples of electrically conductive materials, include, but are not limited to, copper, aluminum, platinum, gold, silver, iron, steel, brass, bronze, graphite, conductive ceramic materials, and/or any combination thereof. Although other profiles are possible, the ends of the conductive pins 236A, 236B of the depicted implementation have a rounded profile such that deflection of the conductive pins 236A, 236B is facilitated when an aerosol generator is inserted into the receiving chamber 230. In other implementations, the conductive pins may be positioned in other locations of the receiving chamber 230, such as, for example, proximate the top of the receiving chamber 230. In other implementations, the conductive pins may be positioned at a point on the sides of the upper frame 206 between the proximal end of the outer housing 202 and the bottom wall of the upper frame 206. Further, in still other implementations the conductive pins may be positioned between a midpoint of the sidewalls and the proximal end of the outer housing 202 (i.e., in an upper half of the sidewalls). Alternatively, the conductive pins may be positioned between a midpoint of the sidewalls and the bottom wall of the inner frame wall (e.g., in a lower half of the sidewalls). Moreover, in still other implementations, the conductive pins may be present at any position of the upper frame 206.

In various implementations, the non-combustible aerosol provision system 100 may include an airflow sensor, pressure sensor, or the like. As noted above, the control component 214 of the depicted implementation includes a pressure sensor 240, which is positioned proximate and below the receiving chamber 230. The position and function of the pressure sensor 240 of the depicted implementation will be described below; however, in other implementations an airflow or pressure sensor may be positioned anywhere within the control device 200 so as to subject to airflow and/or a pressure change that can signal a draw on the device and thus cause the battery 216 to delivery power to the heating member of the consumable 300. Various configurations of a printed circuit board and a pressure sensor, for example, are described in U.S. Pat. Pub. No. 2015/0245658 to Worm et al., the disclosure of which is incorporated herein by reference in its entirety. In the absence of an airflow sensor, pressure sensor, or the like, a non-combustible aerosol provision system may be activated manually, such as via a pushbutton that may be located on the control device, the aerosol generator, and/or the consumable. For example, one or more pushbuttons may be used as described in U.S. Pat. App. Pub. No. 2015/0245658 to Worm et al., which is incorporated herein by reference in its entirety. Likewise, a touchscreen may be used as described in U.S. patent application Ser. No. 14/643,626, filed Mar. 10, 2015, to Sears et al., which is incorporated herein by reference in its entirety. As a further example, components adapted for gesture recognition based on specified movements of the non-combustible aerosol provision system may be used as an input. See U.S. Pat. App. Pub. No. 2016/0158782 to Henry et al., which is incorporated herein by reference in its entirety.

Although not included in the depicted implementation, some implementations may include other types of input elements, which may replace or supplement an airflow or pressure sensor. The input may be included to allow a user to control functions of the device and/or for output of information to a user. Any component or combination of components may be utilized as an input for controlling the function of the device. In some implementations, an input may comprise a computer or computing device, such as a smartphone or tablet. In particular, the non-combustible aerosol provision system may be wired to the computer or other device, such as via use of a USB cord or similar protocol. The non-combustible aerosol provision system may also communicate with a computer or other device acting as an input via wireless communication. See, for example, the systems and methods for controlling a device via a read request as described in U.S. Pat. App. Pub. No. 2016/0007561 to Ampolini et al., the disclosure of which is incorporated herein by reference in its entirety. In such embodiments, an APP or other computer program may be used in connection with a computer or other computing device to input control instructions to the non-combustible aerosol provision system, such control instructions including, for example, the ability to form an aerosol of specific composition by choosing the nicotine content and/or content of further flavors to be included. Additional representative types of sensing or detection mechanisms, structure and configuration thereof, components thereof, and general methods of operation thereof, are described in U.S. Pat. No. 5,261,424 to Sprinkel, Jr.; U.S. Pat. No. 5,372,148 to McCafferty et al.; and PCT WO 2010/003480 to Flick; which are incorporated herein by reference in their entireties.

In the depicted implementation, the pressure sensor seal 210 is configured to cover the pressure sensor 240 to protect it from any liquid and/or aerosol from an installed consumable. In addition, the pressure sensor seal 210 of the depicted implementation is configured to seal the conductive pins 236A, 236B. In such a manner, the pressure sensor seal 210 of the depicted implementation may be made of silicone rubber, boron nitride (BN) rubber, natural rubber, thermoplastic polyurethane, or another resilient material. In the depicted implementation, the upper frame seal 208 is configured to be positioned proximate and above the pressure sensor seal 210, such that a pair of upper frame seal tubes 209A, 209B (see FIG. 9) of the upper frame seal 208 extend through the upper frame 206 and into the receiving chamber 230. The upper frame seal 208 of the depicted implementation may also be made of a silicone, thermoplastic polyurethane, or another resilient material.

Although other configurations are possible, the distal end section 219 of the circuit board 234 includes the external connection element 238. In various implementations, the external connection element 238 may be configured for connecting to an external connector and/or a docking station or other power or data source. For example, in some implementations an external connector may comprise first and second connector ends that may be interconnected by a union, which may be, for example, a cord of variable length. In some implementations, the first connector end may be configured for electrical and, optionally, mechanical connection with the device (100, 200), and the second connector end may be configured for connection to a computer or similar electronic device or for connection to a power source. An adaptor including a USB connector at one end and a power unit connector at an opposing end is disclosed in U.S. Pat. App. Pub. No. 2014/0261495 to Novak et al., which is incorporated herein by reference in its entirety. In the depicted implementation, the pin seal 222 is configured to seal the interface between the external connection element 238 and the end cap 224. In such a manner, the pin seal 222 of the depicted implementation may be made of a silicone, thermoplastic polyurethane, or another resilient material. In the depicted implementation, one or more pins of the external connection element 238 may extend through the end cap 224 of the control device as noted above.

In various implementations, the control device may include one or more components configured to meet battery outgassing requirements under UL 8139. For example, the control device may include an end cap configured to eject in the event that sudden pressurization occurs within the control device enclosure. In one implementation, the end cap may include retaining pins that extend substantially perpendicularly from a wall of the end cap. The retaining pins may be configured to mate with receiving features (e.g., holes) in a frame of the control device to establish a friction fit or press fit that may be overcome if an internal pressure within the control device housing exceeds a defined internal pressure.

The indication window 232 of the depicted implementation of the control device 200 is configured so that at least a portion of the storage compartment 310 is visible when the consumable 300 is engaged with the control device 200, directly or via the aerosol generator 350. As noted above, in some implementations at least a portion of the storage compartment wall 311 may be configured to be at least partially transparent or translucent so that the liquid composition contained therein is visible externally. Thus, the relative amount of any liquid composition present in the storage compartment 310 may be visible through the indication window 232 when the consumable 300 is engaged with the control device 200 and the aerosol generator 350.

As illustrated in FIGS. 5-8B, the indication window 232 of the depicted implementation is located near the proximal end of the control device 200 and is configured as an elongate oval shaped cut-out in the outer wall 204 of the housing 202 and the upper frame 206 of the control device 200. It should be understood that in other implementations, the indication window may have any other shapes and/or locations. For example, in some implementations the indication window may be configured as a notch extending from the proximal end of the outer wall of the control device a distance toward the distal end of the device. In still other implementations, the indication window may be configured so as not to have any open borders and thus may expressly exclude a notch configuration as noted above.

In some implementations, the indication window may be completely open, and in other implementations, the indication window may have a transparent member (e.g., glass or plastic) positioned in the opening defined by the indication window or covering the indication window on one or both of the inner surface and outer surface of the outer wall of the control device. It should be understood that in some implementations, the indication window may be formed in part by the consumable and in part by the control device. For example, in some implementations, the consumable may include a portion of the indication window (e.g., a top portion of an indication window), and the control device may include a separate portion of the indication window (e.g., a bottom portion of the indication window).

FIG. 9 illustrates a perspective partial section view of a control device of a non-combustible aerosol provision system. In particular, FIG. 9 illustrates a partial section view of the housing 202, upper frame 206, upper frame seal 208, pressure sensor seal 210, pressure sensor 240, and lower frame 212 of the control device 200. As shown in the figure, a portion of the conductive pins 236A, 236B of the control component 214 extend through the upper frame 206. In particular, a portion of the conductive pins 236A, 236B of the depicted implementation, which as noted above comprise spring-loaded contacts, extend through a recessed surface 244 of the upper frame 206 and into the receiving chamber 230. In addition, a portion of the upper frame seal tubes 209A, 209B (which define respective seal tube channels 211A, 211B) of the upper frame seal 208 extend through the upper frame 206 and are exposed in the receiving chamber 230. As will be described in more detail below, regardless of the orientation of an installed aerosol generator, the conductive pins 236A, 236B and one of the upper frame seal tubes 209A, 209B are configured to substantially align with corresponding features of an installed aerosol generator.

As also shown in the figure, the upper frame 206 may include an optional pair of magnets 246A, 246B that are also exposed in the receiving chamber 230. In various implementations, the magnets 246A, 246B may comprise any type of magnets, including rare earth magnets. For example, in some implementations, one or more of the magnets may comprise Neodymium magnets (also known as NdFeB, NIB, or Neo magnets). In various implementations, different grades of Neodymium magnets may be used, including, for example, N35, N38, N40, N42, N45, N48, N50, and/or N52 grades. In other implementations, one or more of the magnets may comprise Samarium Cobalt magnets (also known as SmCo magnets). In still other implementations, one or more of the magnets may comprise Ceramic/Ferrite magnets. In other implementations, one or more of the magnets may comprise Aluminum-Nickel-Cobalt (AlNiCo) magnets. In any of the foregoing implementations, one or more of the magnets may be plated and/or coated. For example, in some implementations, one or more of the magnets may be coated with nickel. In other implementations, one or more magnets may be coated with one or more of zinc, tin, copper, epoxy, silver and/or gold. In some implementations, one or more of the magnets may be coated with combinations of these materials. For example, in one implementation, one or more of the magnets may be coated with nickel, copper, and nickel again. In another implementation, one or more of the magnets may be coated with nickel, copper, nickel, and a top coating of gold.

In the depicted implementation, each magnet 246A, 246B is substantially surrounded by a respective location feature 248A, 248B of the upper frame 206, wherein the location features 248A, 248B also extend into the receiving chamber 230. Likewise, each upper frame seal tube 209A, 209B of the upper frame seal 208 is substantially surrounded by a respective location feature 250A, 250B. As will be discussed in more detail below, one or more of the location features 248A, 248B, 250A, 250B of the upper frame 206 are configured as stopping or vertical locating features for an installed aerosol generator and/or consumable and are thus configured to position the aerosol generator 350 with respect to the recessed surface 244 of the upper frame 206 of the control device 200.

In alternative implementations, the receiving chamber 230 includes a retaining structure (e.g., a depression or detent) 231 configured to receive the retention snaps 327 of the aerosol generator latching mechanism 325 to removably receive the aerosol generator 350 therein, and as shown in greater detail with respect to FIG. 23.

As noted above, a portion of the aerosol generator 350 is configured to be coupled with the receiving chamber 230 of the inner frame 206 of the control device 200 such that mechanical and electrical connections are created between the aerosol generator 350 and the control device 200. In particular, when the aerosol generator 350 of the depicted implementation is coupled with the upper frame 206 of the control device 200, for example, via the latching mechanism (retention snaps 327, detents 231), an optional magnetic connection may be created between the magnets 246A, 246B located in the upper frame 206 and corresponding features of the aerosol generator 350. In addition, when the aerosol generator 350 of the depicted implementation is coupled with the inner frame 206, an electrical connection is created between the pair conductive pins 236A, 236B of the control device 200 and corresponding features of the aerosol generator 350. As such, when the aerosol generator 350, with a consumable 300, is received in the receiving chamber 230 of the control device 200, the aerosol generator 350 and the consumable 300 may be operatively connected to the control component 214 and the battery 216 of the control device 200. Thus, when the aerosol generator 350 of the depicted implementation is coupled with the control device 200, the aerosol generator 350 may be mechanically biased into connection with the control device 200 such that electrical connection is maintained between the aerosol generator and the control device. It should be understood that for the purposes of the present disclosure, the term "operatively connected" and other related forms thereof should be interpreted broadly so as to encompass components that are directly connected and/or connected via one or more additional components.

FIGS. 10A, 10B, and 11 depict a non-combustible aerosol provision system 100, according to another example implementation of the present disclosure. As shown in the figures, a control device 200 in accordance with any of the control devices described herein is configured to receive an aerosol generator 650 and a consumable 600 therein. As shown, the aerosol generator 650 is press fit within the chamber 230, either permanently or removably. However, the aerosol generator 650 may be coupled to the control device via a latching mechanism, as previously described. The aerosol generator 650 includes a housing or body 670 defining a cavity 672 in to which a heater assembly 618 is disposed, along with heater contacts 620 and a vaporization chamber 632 similar to those described herein above. The housing 670 includes a lip 674 that rests on the distal end of the control device 200, which may include a recess 646 or similar structure for facilitating removal of the aerosol generator for replacement. Disposed proximate the proximal end or lip of the housing 670 is an access door 641 coupled to an interior wall of the housing 670 and providing a barrier to the heater assembly 618. The access door 641 may be opened via contact with a distal end of the consumable 600.

As shown in FIG. 10B, the consumable 600 may be slid into the aerosol generator housing 670 and held in place via a friction fit or a latching mechanism. The consumable 600 is similar to those described herein above, insofar as it includes a storage tank 610 and a mouthpiece 602 coupled thereto. The storage compartment 610 includes an exterior wall 611 that defines an interior cavity having at least one side wall (exterior wall 611), a proximal end wall 613, and a distal end wall 614 (or base). A reservoir 628 is disposed within the interior cavity and defined by at least one side wall spaced inwardly from the exterior wall, the proximal end wall 613 of the interior cavity, and a liquid transport assembly 616 (see FIGS. 12A and 12B) disposed at a distal end of the reservoir 628. The space between the reservoir 628 and the external wall may define one or more flow paths 633 through the consumable 600. The flow paths 633 may be oriented symmetrically about the consumable. The distal end wall 614 defines an opening (i.e., a portal) therethrough with an access door 640 disposed therein that may be opened via contact with a portion of the aerosol generator 650.

As shown in the FIG. 11, the liquid transport assembly 616 is disposed within the storage compartment 610 and forms a distal end of the reservoir 628. The assembly as shown in FIG. 12B includes a base member 680 sealingly coupled to the reservoir, a liquid transport element 682 disposed thereon, and a top member 684 that secures the assembly together (e.g., snap fit with the base 680) and maintains the liquid transport element 682 in contact with the substrate (e.g., in fluid communication with a liquid composition). In the depicted implementation, the liquid transport element 682 is formed of a cotton material and, when installed in the consumable 600, has a slightly curved shape. In certain implementations, the liquid transport element comprises a deformable material that conforms to the shape of the heater assembly, or other structure within the aerosol generator, on contact therewith. The liquid transport element 682 may be configured to absorb impact between the consumable and the aerosol generator upon coupling. In other implementations, however, the liquid transport element 682 may have other shapes and may be formed of a variety of materials configured for transport of a liquid, such as by capillary action. For example, in some implementations the liquid transport element may be formed of fibrous materials (e.g., organic cotton, cellulose acetate, regenerated cellulose fabrics, glass fibers), porous ceramics, porous carbon, graphite, porous glass, sintered glass beads, sintered ceramic beads, capillary tubes, or the like. In other implementations, the liquid transport element may be any material that contains an open pore network (i.e., a plurality of pores that are interconnected so that fluid may flow from one pore to another in a plurality of direction through the element).

As further discussed herein, some implementations of the present disclosure may particularly relate to the use of non-fibrous transport elements. As such, fibrous transport elements may be expressly excluded. Alternatively, combinations of fibrous transport elements and non-fibrous transport elements may be utilized. Representative types of substrates, reservoirs or other components for supporting the aerosol precursor are described in U.S. Pat. No. 8,528,569 to Newton; U.S. Pat. App. Pub. Nos. 2014/0261487 to Chapman et al. and 2014/0059780 to Davis et al.; and U.S. Pat. App. Pub. No. 2015/0216232 to Bless et al.; which are incorporated herein by reference in their entireties. Additionally, various wicking materials, and the configuration and operation of those wicking materials within certain types of electronic cigarettes, are set forth in U.S. Pat. No. 8,910,640 to Sears et al.; which is incorporated herein by reference in its entirety. In some implementations, the liquid transport element may be formed partially or completely from a porous monolith, such as a porous ceramic, a porous glass, or the like. Example monolithic materials suitable for use according to embodiments of the present disclosure are described, for example, in U.S. patent application Ser. No. 14/988,109, filed Jan. 5, 2016, and US Pat. No. 2014/0123989 to LaMothe, the disclosures of which are incorporated herein by reference in their entireties. The base member 6870 and the top member 684 may be manufactured from any of the materials disclosed herein.

Referring back to FIG. 11, the aerosol generator 650 is disposed within the receiving chamber 632 of the control device 200 and the consumable 600 is introduced to the cavity 672 of the aerosol generator by sliding or otherwise pushing the consumable past the access door 641 of the aerosol generator, which is forced open when contacted by a portion of a distal end of the storage compartment 610 when the storage compartment first engages the aerosol generator (downward arrows in FIG. 11). A user continues to slide the consumable into the cavity 672 until the liquid transport assembly 616 contacts the heater assembly 618. The access door 640 of the storage compartment 610 is forced open by contact with a portion of the heater assembly when the consumable 600 further engages the aerosol generator (upward arrow in FIG. 11).

FIGS. 28A and 28B illustrate an alternative configuration for the coupling of the consumable and the aerosol generator to provide additional buffering of the impact therebetween when coupled. Specifically, the aerosol generator 650 may incorporate a buffering mechanism 662 in the form of a spring plate; however, other resilient mechanisms are contemplated and considered within the scope of the invention. The buffering mechanism 662 may be incorporated into any of the aerosol generators described herein. Generally, the buffering mechanism 662 may reduce or eliminate heater deformation when the consumable and aerosol generator are joined together and ensure appropriate mating between the two components.

As shown in FIG. 28A, the buffering mechanism 662 includes a plate or fixture 663 slidably disposed within the aerosol generator body 670 (e.g., a recess disposed therein) and that is configured to engage one or more of the heater assembly 618, the heater contacts 620, and the vaporization chamber 632. A spring element 665 is disposed beneath the plate 663 and operatively coupled to the plate 663, the body 670, or both. FIG. 28A depicts the buffering mechanism 662 in an essentially neutral position, e.g., no force has been applied to the heater assembly 618. FIG. 28B depicts the buffering mechanism 662 in an active or slightly compressed position where the consumable 600 has been coupled to the aerosol generator, the liquid transport element is in contact with the heater assembly, and the spring element 665 has been compressed. The specific type of spring element, size, and properties thereof will be selected to suit a particular application.

The various seals and access doors comprise elastomeric materials that are configured to engage various components so as to form substantially air tight and/or liquid tight seals therebetween. In various implementations, the elastomeric materials may include silicone rubber, boron nitride (BN) rubber, natural rubber, thermoplastic polyurethane, or another resilient material. In the depicted implementation, the base member 614 may be made of a molded polymer material, such as, for example, a molded plastic material (e.g., acrylonitrile butadiene styrene (ABS), polyethylene, polycarbonate, Polyamide (Nylon), high impact polystyrene, polypropylene, and combinations thereof), although other materials are possible.

FIGS. 13 and 14 depict non-combustible aerosol provision systems, according to alternative example implementations of the present disclosure. Specifically, FIGS. 13 and 14 depict alternative consumable 700, 800 and aerosol generator 750, 850 configurations. As shown in FIG. 13, an aerosol generator 750 is disposed within a receiving chamber of a control device and configured to receive the consumable 700. The control device may be in accordance with any of the control devices described herein that is configured to receive an aerosol generator and a consumable therein and provide power to the aerosol generator. As shown, the aerosol generator 750 includes a housing or body 770 defining a cavity 772 in to which a heater assembly 718 and a liquid transport assembly 716 are disposed, along with heater contacts and a vaporization chamber similar to those described herein above. The housing 770 may include a latching mechanism 727 (or portion thereof) that interfaces with the distal end of the control device. Also included in the housing is one or more sharpened fluid delivery devices 709 (e.g., a needle coupled to a plate for stability) that is configured to pierce the consumable as described herein below.

The consumable 700 of FIG. 13 may be slid into the aerosol generator housing 772 and removably secured therein via a latching mechanism 725. The consumable 700 is similar to those described herein above, insofar as it includes a storage tank 710 and a mouthpiece 702 coupled thereto. The storage compartment 710 includes a base member 714 that provides the latching mechanism 725 and defines the portal for providing the substrate to the aerosol generator. In the depicted implementation, the portal includes one or more openings 743 disposed in a distal end of the base member 714 and a self-healing membrane 790 disposed within and coupled to the storage compartment 710 via the base member. The one or more openings 743 disposed in the distal end of the base member 714 are configured to expose portion(s) of the self-healing membrane for interfacing with the aerosol generator 750.

Specifically, when the consumable is fully inserted into the aerosol generator, the one or more sharpened fluid delivery device 709, which are oriented within the aerosol generator to correspond to the opening 743 in the base member 714, pierce the membrane 790 in the one or more locations to provide fluid communication between the storage compartment 710 and the liquid transport element 716/vaporization chamber 734. The specific number of, size, cross-sectional shape, and placement of the sharpened fluid delivery channel 709 will vary to suit a particular application. Upon removal of the consumable, the openings in the membrane 790 created by the sharpened fluid delivery device "heal" (i.e., close back up).

As shown in FIG. 14, an aerosol generator 850 is disposed within a receiving chamber of a control device and configured to receive the consumable 800. The control device may be in accordance with any of the control devices described herein that is configured to receive an aerosol generator and a consumable therein and provide power to the aerosol generator. As shown, the aerosol generator 850 includes a housing or body 870 defining a cavity 872 in to which a heater assembly 818 and a liquid transport assembly 816 are disposed, along with heater contacts 820 and a vaporization chamber 832 similar to those described herein above. The aerosol generator may be removably or fixedly disposed within the receiving chamber as described herein. The liquid transport element 818 includes a relatively rigid or semi-rigid portion 817 extending upwardly therefrom for interfacing with the consumable 800 as described herein below. In some implementations, the portion 817 may be or comprise a rigid or semi-rigid fluid delivery channel. The heater assembly 818 and liquid transport element 816 are shown offset in FIG. 14; however, the exact location, along with size, may vary to suit a particular application.

The consumable 800 of FIG. 14 may be slid into the aerosol generator housing 870 and removably secured therein via any manner as described herein. The consumable 800 is similar to those described herein above, insofar as it includes a storage tank 810 and a mouthpiece 802 coupled thereto. The storage compartment 810 includes a base member 814 having a portal comprising a slit valve 894 disposed therein that is configured to be opened via contact with the rigid portion 817 of the liquid transport element 816. Only one slit valve is shown in FIG. 14; however, multiple slit valves may be included to suit a particular application. Specifically, when the consumable 800 is fully inserted into the aerosol generator 850, the rigid portion 817, which is oriented within the aerosol generator to correspond to the position of the slit valve in the base 814, extends through the slit valve and provides fluid communication between the storage compartment 810 and the vaporization chamber 834. The specific number of, size, cross-sectional shape, and placement of the rigid portion 817 will vary to suit a particular application. In addition, a portion of the liquid transport element 816 should provide a certain level of heat resistance to prevent heat transfer to the slit valve 894, which may be damaged if exposed to excessive heat (e.g., warped so as to no longer seal the reservoir. The liquid transport element 816 may further include a certain level of impact resistance to protect the heater assembly 818 from excessive impact on the coupling of the consumable with the aerosol generator.

FIGS. 15 and 16 depict a non-combustible aerosol provision system 100, according to another example implementation of the present disclosure. As shown in the figures, a control device 200 in accordance with any of the control devices described herein is configured to receive an aerosol generator 950 and a consumable 900 therein. As shown, the aerosol generator 950 slidingly engages the control device 200 and is removably secured therein via a latching mechanism 927 (or a first portion 927A thereof). In some implementations, the aerosol generator 950 may include a lip 974 configured to assist with locating and/or removing the aerosol generator with respect to the control device. The aerosol generator 950 is described in greater with respect to in FIGS. 20-22. The consumable 900 is configured to slidingly engage the aerosol generator 950 and is removably secured therein via a latching mechanism 925 (or a first portion 925A thereof). The consumable 900 is described in greater detail with respect to FIGS. 17-19.

As shown in FIGS. 17-19, the consumable 900, which is similar to those described herein above, includes a storage tank 910 coupled to a mouthpiece 902, where they define a reservoir 928 configured to receive a substrate (i.e., a liquid composition). The distal end of the storage compartment has a base 924 defining several openings therethrough to provide for passage of the liquid composition (fluid ports 949) and an aerosol (vapor port 930) formed therefrom. Disposed within the storage compartment and sealingly coupled to the base 924 is a plenum assembly 945 configured to sealingly couple the ports 949, 930 with their respective interfaces. Specifically, the central port of the plenum assembly 945 is coupled to an upper flow tube 933A formed within the mouthpiece 902 and configured to deliver the aerosol to a user (see FIG. 19).

Although not directly shown, the mouthpiece 902 and/or storage compartment 910 may include one or more additional air flow passages defined, for example, via an internal wall and an external wall and running through the consumable 900. Generally, a vaporization chamber of the aerosol generator may be in fluid communication with the consumable via these additional air flow passages and the central air flow tube 933A, merging at the proximal end of the mouthpiece. For example, air may enter the system 100 through a gap between the consumable and one or both of the control device and the aerosol generator, the air flow entering the vaporization chamber of the aerosol generator and carrying the aerosol along a first path extending through the consumable and a second path extending at least partially about the consumable before merging with the first path.

As shown in FIG. 18, a proximal end of the storage compartment 910 is secured within the distal end of the mouthpiece so that the end ports of the plenum assembly 945 sealingly engage with the openings 930, 949 in the distal end of the storage compartment. A foil seal 947 (or similar material) is adhered to the outer surface of the distal end of the storage compartment to seal the fluid ports 949 so that the liquid composition does not exit the reservoir 928 until engaged with the aerosol generator 950 as described herein below. Additionally, a second latching mechanism 925, specifically two first halves or portions 925A of the second latching mechanism are disposed on an outer surface of the storage compartment and configured to removably engage mating second halves or portions 925B of the second latching mechanism disposed within the aerosol generator 950 and described in greater detail below.

As shown in FIGS. 20-22, the aerosol generator 950, which is similar to those described herein, includes a housing or body 970 defining a cavity 972 into which a heater assembly 918 and a liquid transport assembly 916 are disposed, along with heater contacts 920 and a vaporization chamber 932. Specifically, a base 926 having the heater contacts 920 disposed therethrough for electrically coupling with the power source in the control device is sealingly coupled to the distal end of the housing 970 via a seal assembly 922, which at least partially defines the vaporization chamber 932 disposed beneath the heater assembly 918. Disposed above the seal assembly 922 and within the cavity 972 is a fixture 943 that interconnects the heater assembly 918, liquid transport element 916, vaporization channel 932, and a pair of flow tubes 959. The flow tubes 959 are configured to engage with the storage compartment 910 via the ports 949 in the plenum assembly 949 and transport the liquid composition to the liquid transport element 916. The aerosol generator assembly further includes a lower flow tube 933B in fluid communication with the vaporization chamber 932 and configured to interface the vapor port 930 in the plenum assembly 945.

The aerosol generator 950 includes a first latching mechanism 927, specifically two first halves or portions 927A of the first latching mechanism disposed on an outer surface of the aerosol generator housing 970 and configured to removably engage mating second halves or portions 927B disposed within the receiving chamber of the control device (see FIG. 23). The first latching mechanism 927 is configured to removably couple the aerosol generator to the control device housing via a snap fit. Disposed within the aerosol generator cavity 972, specifically on an interior wall of the housing 970 (see FIG. 22), are the mating second halves 925B of the second latching mechanism, which provide a snap fit between the consumable and the aerosol generator. The mating second halves 925B of the second latching mechanism are disposed proximate the first halves 927A of the first latching mechanism. This arrangement provides that when the consumable 900 is engaged with the aerosol generator 950, which is already engaged with the control device, the latching of the second latching mechanism 925 reinforces the latching structure of the first latching mechanism 927 so as to prevent inadvertent removal of the aerosol generator from the housing when removing the consumable. In some implementations, the action of the engagement and disengagement between the first and second halves of the second latching mechanism 925 may further deploy the first halves of the first latching mechanism deeper into the mating halves thereof disposed within the receiving chamber.

FIG. 23 depicts the engagement of the aerosol generator 950 with the control device housing 202 and the engagement of the consumable 900 thereto. As shown, the aerosol generator snap fits within the control device receiving chamber via the first latching mechanism 927 so that the heater contacts 920 are electrically coupled to the conductive pins 236 of the control device to provide power to the heater assembly 918. The consumable 900 is slidingly engaged with the aerosol generator such that the flow tubes 959 puncture the foil seal 947 and fluidly engage the reservoir 928 via the fluid ports 949. When fully engaged via the second latching mechanism 925, the consumable 900 is snap fit within the cavity 972 of the aerosol generator 950. Generally, the second latching mechanism is configured to reinforce the first latching mechanism so as to prevent inadvertent removal of the aerosol generator from the housing. In one implementation, the first portions of the mechanisms include protuberances that are flexibly coupled to their respective component/housing and the second portions include recesses that are complimentarily shaped to the protuberances and configured to receive the protuberances therein. When the consumable is inserted into the aerosol generator, the protuberances flex inwardly so that the consumable can enter the cavity 972, and when the mating recess is reached, the protuberances are biased outwardly into their respective recesses via the spring force of the flexible coupling between the protuberances and the consumable. While inserting or removing the consumable, this spring force is acting on the wall of the aerosol generator body and resulting in a radially outward force on the body 970, and consequently, on the protuberances of the first portions of the first latching mechanisms disposed on the exterior surface of the body 670. This force is additive to the spring force of the flexible coupling of the protuberances to the aerosol generator body resulting in additional force being applied to the protuberances within the mating recesses of the receiving chamber. Accordingly, the removable coupling between the aerosol generator and the receiving cavity is strengthened when removing the consumable. In addition to the aerosol flow path 933 delivering the aerosol to the user, there are one or more additional or alternative flow paths 964A, 964B that exit the vaporization chamber 932, which is disposed beneath the heater assembly 918 and the liquid transport element 916, and travel up and around the heater system, as shown by the arrows 964. The aerosol flow paths 964A, 964B merge above the heater assembly, enter the flow tubes 933, and travel through the consumable to the user. The aerosol may travel through one or more passageways defined between the heater assembly and interior walls of the aerosol generator body 970.

Referring back to FIG. 1, when a user of one of the non-combustible aerosol provision systems 100 described herein draws on the mouthpiece 302, inlet airflow is directed into the device 100 via a gap 301 (601 in FIG. 10A) between the consumable 300 (e.g., an outer wall of the consumable 300) and the aerosol generator 350 or the control device 200 (e.g., an inner wall of the control device 200 defining the receiving chamber 230 thereof). The gap 301 comprises a peripheral gap that extends around substantially the entire periphery of the consumable 300. It should be understood that in other implementations, the gap need not extend around the entire periphery of the consumable, for example in some implementations the gap may comprise one or more gaps that extend around a portion of the periphery of the consumable rather than the entire periphery, and in some implementations, the gap may comprise one or more individual holes. The gap 301 originates at an interface between an outside surface of the consumable 300 and an inside surface of the aerosol generator 350 and/or the control device 200. In particular, the gap 301 originates at the interface of an outer surface of the mouthpiece 302 of the consumable 300 and a top edge of the outer wall 204 of the housing 202 of the control device 200. In other implementations, however, the gap may originate at another interface between the consumable and the aerosol generator and/or the control device.

In some implementations, the gap 301 between the consumable 300 and the aerosol generator 350 and/or the control device 200 is established and maintained by features of the control device 200. Although other configurations are possible, the upper frame 206 of the depicted implementation includes a plurality of protuberances 260 (see FIG. 9) that are spaced around an inner surface of the upper frame 206 and that are configured to laterally position the consumable 300. In the depicted implementation, the plurality of protuberances 260 comprise a plurality of raised elongate bosses that extend from an approximate top of the upper frame 206 to a recessed surface 244 thereof. When the consumable 300 of the depicted implementation is coupled with the aerosol generator 350 and/or the control device 200, the plurality of protuberances 260 of the upper frame 206 contact an outer surface of the consumable 300 (and in particular, an outer surface of the mouthpiece 302 and/or an outer surface of the storage compartment 310 and/or an outer surface of the bottom cap 326). In such a manner, the protuberances 260 position the consumable 300 and/or the aerosol generator 350 laterally with respect to the upper frame 206, thus establishing and maintaining the gap 301. It should be understood that in other implementations, the protuberances may take other forms (including, for example, one or more bumps), and may be located on one or more components of the consumable rather than (or in addition to) the control device.

As the air is drawn through the inlet channel into the aerosol generator 350, the pressure sensor 240 of the control device 200 detects the draw. In the depicted implementation, the pressure sensor 240 may detect a draw by sensing a pressure drop in the consumable 300 or aerosol generator 350. When the draw is detected by the pressure sensor 240, the control component 214 directs current through the heating member 318 in order to heat the heating member 318. As the heating member 318 heats, at least a portion of the liquid composition contained in the liquid transport element 316 is vaporized in the vaporization chamber 332. Accordingly, aerosol produced in the vaporization chamber 332 may then directed to the user. In particular, as the air enters the system 100 via the air inlet channel, the air travels through the vaporization chamber 332 where it impinges on the heating member 318 substantially perpendicularly thereto and mixes with the vaporized liquid composition to become the aerosol. Due to the geometry of the vaporization chamber 332 and the aerosol generator, the aerosol is split into two separate paths that extend therethrough and then through the one or more aerosol flow tubes 333A, 333B. This relatively tortuous configuration may increase the effective flow path length and area for heat sinking, thus providing increased cooling of the aerosol stream prior to reaching the user. As shown in the figures, the two aerosol paths converge at the proximal end of the storage compartment 310 and below the upper aerosol channel insert 306. The recombined aerosol then flows through the upper aerosol channel insert 306 and out of the exit portal 315 of the mouthpiece 300, to the user. It should be understood that the aerosol passages downstream from the air inlet channel inlet are configured to be oversized, in order to minimize any additional system pressure drop created by these passages. In this manner, the device is configured such that the greatest portion of the system pressure drop is present in the location of a pressure channel to maximize the pressure "signal" available to the pressure sensor 240.

As shown in the figures, the various heating members 318 are configured to be disposed within a housing or body that is configured to engage with a consumable 300. In particular, the heating member 318 of the depicted implementations comprises a heating element that has a substantially flat profile (e.g., initially formed as a substantially planar element). Although other implementations may differ, in some depicted implementations, the heating member 318 includes a first end, a second end, and a heater loop connecting the first end and the second end. In particular, the heater loop of the depicted implementation comprises a serpentine pattern of heater traces that are connected at respective ends thereof and that extend substantially transverse to a longitudinal axis of the heating member to connect the first end to the second end. While in some implementations the heater traces may be solid, the heater traces of the depicted implementation comprise a plurality of split traces. In the depicted implementation, the edges of the heating member are substantially solid and the plurality of split traces are located in a central area of the heating member. In such a manner, the heater loop of the depicted implementation may be configured to concentrate heat in an area of the heating element configured to be in contact with the liquid transport element 316.

While in some implementations the heating member may maintain a substantially flat profile when installed in an aerosol generator, the heating member 318 may also be installed having a curved or bowed shape corresponding to a curved shape of a liquid transport element. In such a manner, the heating member 318 in the installed position contacts a bottom surface of the liquid transport element 316. In the depicted implementation, the curved form of the flat heating member 318 may provide a large ratio of cross-sectional flow area to flow path length through the liquid transport element 316. This may provide increased performance with respect to delivery of the liquid composition to the liquid transport element 316. When installed, edges of the heating member 318 are configured to engage the aerosol generator such that the heating member 318 maintains its curved shape. In such a manner, the curvature of the heating member 318 may also provide a compressive force against the liquid transport element 316. The installed curvature of the heating member 318 may also bias deflection of the heating member 318 that may occur with thermal expansion towards the liquid transport element 316, thus helping to maintain thermal contact between the heating member 318 and the liquid transport element 316. In some depicted implementations, the liquid transport element 316 and the heating member 318 comprise a heating assembly that defines a vaporization chamber 332.

It should be noted that some implementations need not include a heating assembly, but, rather, may include an atomization assembly configured to generate an aerosol in another manner. Some examples of atomization assemblies that generate aerosols in other ways can be found, for example, in U.S. patent application Ser. No. 16/544,326, filed on Aug. 19, 2019, and titled Detachable Atomization Assembly for Aerosol Delivery Device, which is incorporated herein by reference in its entirety.

In the depicted implementation, the heating member 318 may be made of a metal material, such as a stainless steel material, including, but not limited to, 316L, 316, 304, or 304L stainless steel. In other implementations, the heating member may be made of a different material, such as, for example, Kanthal (FeCrAl), Nichrome, Molybdenum disilicide ($MoSi_2$), molybdenum silicide (MoSi), Molybdenum disilicide doped with Aluminum ($Mo(Si,Al)_2$), titanium, platinum, silver, palladium, alloys of silver and palladium, graphite and graphite-based materials (e.g., carbon-based foams and yarns). In further implementations, the heating member may be formed from conductive inks, boron doped silica, and/or ceramics (e.g., positive or negative temperature coefficient ceramics). Other types of heaters may also be utilized, such as laser diodes or microheaters. A laser diode can be configured to deliver electromagnetic radiation at a specific wavelength or band of wavelengths that can be tuned for vaporization of the aerosol precursor composition and/or tuned for heating a liquid transport element via which the aerosol precursor composition may be provided for vaporization. The laser diode can particularly be positioned so as to deliver the electromagnetic radiation within a chamber, and the chamber may be configured to be radiation-trapping (e.g., a black body or a white body). Suitable microheaters are described in U.S. Pat. No. 8,881,737 to Collett et al., which is incorporated herein by reference in its entirety. Microheaters, for example, can comprise a substrate (e.g., quartz, silica) with a heater trace thereon (e.g., a resistive element such as Ag, Pd, Ti, Pt, Pt/Ti, boron-doped silicon, or other metals or metal alloys), which may be printed or otherwise applied to the substrate. A passivating layer (e.g., aluminum oxide or silica) may be provided over the heater trace. Other heaters are described in U.S. Pat. App. Pub. No. 2016/0345633 to DePiano et al., which is incorporated herein by reference in its entirety.

Although in other implementations additional and/or differing contact features may be provided, the heating member 318 of the depicted implementations includes a pair of contact holes that are configured to connect the heating member 318 to the heater connectors 320A, 320B. In some depicted implementations, the heater connectors 320A, 320B are made of a conductive material and are plated with nickel and/or gold. Examples of conductive materials include, but are not limited to, copper, aluminum, platinum, gold, silver, iron, steel, brass, bronze, graphite, conductive ceramic materials, and/or any combination thereof. In the depicted implementation, the contact holes may be configured to have an inner diameter that is less than an outer diameter of the mating portions of the heater connectors 320A, 320B. In some implementations, the contact holes may include one or more features (e.g., one or more fingers or extensions) that create an effective inner diameter that is less than an outer diameter of the mating portion of the heater connectors 320A, 320B. In such a manner, the contact holes of the heating member 318 may create an interference fit with the upper ends of the heater connectors 320A, 320B, such that the heating member 318 may maintain electrical contact with the heater connectors 320A, 320B. In the depicted implementation, the lower end of the heater connectors 320A, 320B are sealed around respective circumferential surfaces thereof by the pair of O-rings, which are configured to form a substantially air tight and liquid tight seal between the heater connectors 320A, 320B and the aerosol generator cavity. The O-rings may be made of silicone rubber, boron nitride (BN) rubber, natural rubber, thermoplastic polyurethane, or another resilient material.

FIG. 24 illustrates an exploded perspective view of a control device of a non-combustible aerosol provision system, according to another example implementation of the present disclosure. As shown in the figure, the control device 400 of the depicted implementation generally includes a housing 402 defining an outer wall 404, an upper frame 406, a pressure sensor seal 410, a lower frame 412, a control component 414, a battery 416, a vibration motor 418, a motor housing 420, a pin seal 422, an end cap 424, a light diffuser 426 (shown assembled to the end cap 424), and a vent 439. The control device 400 of the depicted implementation also includes a front foam pad 431, a back foam pad 433, an upper chassis seal 435, and a base seal 437. In the depicted implementation, the front foam pad is configured to be disposed between the battery 416 and the control component 414, and the back foam pad 433 is configured to be disposed between the battery 416 and the lower frame 412. The upper chassis seal 435 is configured to seal around the upper frame 406, and the base seal 437 is configured to seal around the end cap 424. The arrangement of the components of the control device 400 is illustrated in FIG. 25. In particular, FIG. 25 illustrates a front section view of the control device 400. As illustrated in the figure, the upper frame 406 of the control device 400 defines a receiving chamber 430 within which an aerosol generator and a consumable may be coupled. The control device 400 also includes a pair of opposite indication windows 432 that are defined through the outer wall 404 of the housing 402, as well as through the upper frame 406. As will be described in more detail below, in various implementations the indication windows 432 may provide a user with the ability to view one or more components (and/or conditions thereof) of an installed consumable. It will be appreciated, however, that the illustrated indication windows 432 are provided by way of example and not by way of limitation. For example, alternative implementations may include an indication window 432 having a different shape than that illustrated. As another example, some implementations may include only a single indication window 432 or may omit the indication windows 432 altogether. In the depicted implementation, the upper frame 406 and the housing 402 represent different parts; however, in other implementations, the upper frame and the housing may be continuously formed such that they comprise the same part.

In the depicted implementation, the housing 402 comprises a metal material, such as, for example, aluminum; however, in other implementations the housing may comprise a metal alloy material, and in still other implementations the housing may comprise a molded polymer material. In the depicted implementation, one or more of the upper frame 406, lower frame 412, and end cap 424 may be made of a molded polymer material, such as, for example, a molded plastic material (e.g., polybutylene terephthalate (PBT), acrylonitrile butadiene styrene (ABS), polyethylene, polycarbonate, Polyamide (Nylon), high impact polystyrene, polypropylene, and combinations thereof). In other implementations, one or more of these components may be made of other materials, including, for example, metal materials (e.g., aluminum, stainless steel, metal alloys, etc.), glass materials, ceramic materials (e.g., alumina, silica, mullite, silicon carbide, silicon nitride, aluminum nitride, etc.), composite materials, and/or any combinations thereof.

In the depicted implementation, the lower frame 412 is configured to contain the battery 416 in an interior area thereof. In the depicted implementation, the battery may comprise a lithium polymer (LiPo) battery; however various other batteries may be suitable. Some other examples of batteries that can be used according to the disclosure are described in U.S. Pat. App. Pub. No. 2010/0028766 to Peckerar et al., the disclosure of which is incorporated herein by reference in its entirety. In some implementations, other types of power sources may be utilized. For example, in various implementations a power source may comprise a replaceable battery or a rechargeable battery, solid-state battery, thin-film solid-state battery, rechargeable super-capacitor or the like, and thus may be combined with any type of recharging technology, including connection to a wall charger, connection to a car charger (e.g., cigarette lighter receptacle, USB port, etc.), connection to a computer, such as through a universal serial bus (USB) cable or connector (e.g., USB 2.0, 3.0, 3.1, USB Type-C), connection to a USB connector (e.g., USB 2.0, 3.0, 3.1, USB Type-C as may be implemented in a wall outlet, electronic device, vehicle, etc.), connection to a photovoltaic cell (sometimes referred to as a solar cell) or solar panel of solar cells, a wireless charger, such as a charger that uses inductive wireless charging (including for example, wireless charging according to the Qi wireless charging standard from the Wireless Power Consortium (WPC)), or a wireless radio frequency (RF) based charger, and connection to an array of external cell(s) such as a power bank to charge a device via a USB connector or a wireless charger. An example of an inductive wireless charging system is described in U.S. Pat. App. Pub. No. 2017/011216 to Sur et al., which is incorporated herein by reference in its entirety. In further implementations, a power source may also comprise a capacitor. Capacitors are capable of discharging more quickly than batteries and can be charged between puffs, allowing the battery to discharge into the capacitor at a lower rate than if it were used to power the heating member directly. For example, a super-capacitor—e.g., an electric double-layer capacitor (EDLC)—may be used separate from or in combination with a battery. When used alone, the super-capacitor may be recharged before each use of the article. Thus, the device may also include a charger component that can be attached to the smoking article between uses to replenish the super-capacitor. Examples of power supplies that include super-capacitors are described in U.S. Pat. App. Pub. No. 2017/011211 to Sur et al., which is incorporated herein by reference in its entirety.

The non-combustible aerosol provision system 400 of the depicted implementation includes a control mechanism in the form of the control component 414, which is configured, in part, to control the amount of electric power provided to the heating member of the consumable. Although other configurations are possible, the control component 414 of the depicted implementation comprises a circuit board 434 (e.g., a printed circuit board (PCB)) that includes both rigid and flexible portions. In particular, the circuit board 434 of the depicted implementation includes a rigid central section 415 and two rigid end sections comprising a proximal end section 417 and a distal end section 419, with each of the end sections 417, 419 being connected to the central section 415 by a respective flexible connection. In such a manner, when the lower frame 412, battery 416, and circuit board 434 are assembled into the control device 400, the central section 415 of the circuit board 434 is configured to be disposed proximate a major surface of the battery 416, and the two end sections 417, 41 are configured to be disposed substantially perpendicular to the central section 415. In particular, the proximal end section 417 of the circuit board 434 is configured to extend over the top of the lower frame 412, and the distal end section 41 is configured to extend over the bottom of the lower frame 412. The lower frame 412 of the control device 400 is also configured to contain the motor housing 420, into which the vibration motor 418 is received. In various implementations, the vibration motor 418 may provide haptic feedback relating to various operations of the device.

The central section 415 of the depicted implementation also includes an indicator in the form of a light source 421. In some implementations, the light source may comprise, for example, at least one light emitting diode (LED) capable of providing one or more colors of light. In other implementations, the light source may be configured to illuminate in only one color, while in other implementations, the light source may be configured to illuminate in variety of different colors. In still other implementations, the light source may be configured to provide white light. In the depicted implementation, the light source 421 comprises an RGB (red, green, blue) LED that is configured to provide a variety of colors of light, including white light. The central section 415 of the depicted circuit board 434 also includes electrical contacts 423 that are configured to operatively connect the circuit board 434 to the vibration motor 418. Other types of electronic components, structures and configurations thereof, features thereof, and general methods of operation thereof, are described in U.S. Pat. No. 4,735,217 to Gerth et al.; U.S. Pat. No. 4,947,874 to Brooks et al.; U.S. Pat. No. 5,372,148 to McCafferty et al.; U.S. Pat. No. 6,040,560 to Fleischhauer et al.; U.S. Pat. No. 7,040,314 to Nguyen et al. and U.S. Pat. No. 8,205,622 to Pan; U.S. Pat. App. Pub. Nos. 2009/0230117 to Fernando et al., 2014/0060554 to Collet et al., and 2014/0270727 to Ampolini et al.; and U.S. Pat. App. Pub. No. 2015/0257445 to Henry et al.; which are incorporated herein by reference. Yet other features, controls or components that can be incorporated into non-combustible aerosol provision systems of the present disclosure are described in U.S. Pat. No. 5,967,148 to Harris et al.; U.S. Pat. No. 5,934,289 to Watkins et al.; U.S. Pat. No. 5,954,979 to Counts et al.; U.S. Pat. No. 6,040,560 to Fleischhauer et al.; U.S. Pat. No. 8,365,742 to Hon; U.S. Pat. No. 8,402,976 to Fernando et al.; U.S. Pat. App. Pub. Nos. 2010/0163063 to Fernando et al.; 2013/012623 to Tucker et al.; 2013/0298905 to Leven et al.; 2013/0180553 to Kim et al., 2014/0000638 to Sebastian et al., 2014/0261495 to Novak et al., and 2014/0261408 to DePiano et al.; which are incorporated herein by reference in their entireties.

In the depicted implementation, the vent 439 is configured to be installed on the inside of the housing 402 such that it covers the aperture 425. As such, in the depicted implementation one side of the vent 439 may include a pressure sensitive adhesive. In the depicted implementation, the vent 439 comprises a breathable membrane material, such as, for example, a Gore-Tex® material; however, other suitable materials are possible. In the depicted implementation, the light source 421 is covered by the light diffuser 426, a portion of which is configured to be received by the end cap 424. In such a manner, when assembled, the light diffuser 426 is positioned in or proximate an aperture 425 defined in the outer wall 404 of the housing 402 and proximate a distal end thereof. In the depicted implementation, the aperture 425 comprises a narrow, elongate opening; however, in other implementations, the aperture may be provided in any desired shape and may be positioned at any location on the control device 400. In some implementations, the light diffuser 426 may comprise a transparent or translucent member configured to allow a user to view the light source 421 from the outside of the housing 402. In the depicted implementation, the light diffuser 426 may be made of a molded polymer material, such as, for example, a molded plastic material (e.g., polybutylene terephthalate (PBT), acrylonitrile butadiene styrene (ABS), polyethylene, polycarbonate, Polyamide (Nylon), high impact polystyrene, polypropylene, and combinations thereof), although other materials, including glass, are possible. In various implementations, further indicators (e.g., other haptic feedback components, an audio feedback component, or the like) can be included in addition to or as an alternative to the indicators included in the depicted implementation. Additional representative types of components that yield visual cues or indicators, such as LED components, and the configurations and uses thereof, are described in U.S. Pat. No. 5,154,12 to Sprinkel et al.; U.S. Pat. No. 8,499,766 to Newton and U.S. Pat. No. 8,539,959 to Scatterday; U.S. Pat. App. Pub. No. 2015/0020825 to Galloway et al.; and U.S. Pat. App. Pub. No. 2015/0216233 to Sears et al.; which are incorporated herein by reference in their entireties.

Although other configurations are possible, the proximal end section 417 of the circuit board 434 of the depicted implementation includes a pair of conductive pins 436A, 436B, as well as a pressure sensor 440. In the depicted implementation, the conductive pins 436A, 436B comprise spring-loaded pins (e.g., electrical pogo pins) that extend through the upper frame 406 such that portions of the ends of the pins 436A, 436B extend into the receiving chamber 430 and are biased in that position due to the force of the internal springs of the conductive pins 436A, 436B. In such a manner, when an aerosol generator (with or without a consumable) is coupled with the control device 400, the conductive pins 436A, 436B are configured to contact corresponding features of the aerosol generator and deflect downward (e.g., toward the lower frame 412) against the force of the springs, thus operatively connecting the installed aerosol generator with the control component 414 and the battery 416. In the depicted implementation, the conductive pins 436A, 436B comprise gold plated metal pins; however, other materials or combinations of materials, which may also include coatings and/or platings of electrically conductive materials, are possible. Examples of electrically conductive materials, include, but are not limited to, copper, aluminum, platinum, gold, silver, iron, steel, brass, bronze, graphite, conductive ceramic materials, and/or any combination thereof. Although other profiles are possible, the ends of the conductive pins 436A, 436B of the depicted implementation have a rounded profile such that deflection of the conductive pins 436A, 436B is facilitated when an aerosol generator is inserted into the receiving chamber 430. In other implementations, the conductive pins may be positioned in other locations of the receiving chamber 430, such as, for example, proximate the top of the receiving chamber 430. In other implementations, the conductive pins may be positioned at a point on the sides of the upper frame 406 between the proximal end of the outer housing 402 and the bottom wall of the upper frame 406. Further, in still other implementations the conductive pins may be positioned between a midpoint of the sidewalls and the proximal end of the outer housing 402 (i.e., in an upper half of the sidewalls). Alternatively, the conductive pins may be positioned between a midpoint of the sidewalls and the bottom wall of the inner frame wall (e.g., in a lower half of the sidewalls). Moreover, in still other implementations, the conductive pins may be present at any position of the upper frame 406.

In various implementations, the non-combustible aerosol provision system may include an airflow sensor, pressure sensor, or the like. As noted above, the control component 414 of the depicted implementation includes a pressure sensor 440, which is positioned proximate and below the receiving chamber 430. The position and function of the pressure sensor 440 of the depicted implementation will be described below; however, in other implementations an airflow or pressure sensor may be positioned anywhere within the control device 400 so as to subject to airflow and/or a pressure change that can signal a draw on the device and thus cause the battery 416 to delivery power to the heating member of a consumable. Various configurations of a printed circuit board and a pressure sensor, for example, are described in U.S. Pat. App. Pub. No. 2015/0245658 to Worm et al., the disclosure of which is incorporated herein by reference in its entirety. In the absence of an airflow sensor, pressure sensor, or the like, a non-combustible aerosol provision system may be activated manually, such as via a pushbutton that may be located on the control device and/or the consumable. For example, one or more pushbuttons may be used as described in U.S. Pat. App. Pub. No. 2015/0245658 to Worm et al., which is incorporated herein by reference in its entirety. Likewise, a touchscreen may be used as described in U.S. patent application Ser. No. 14/643,626, filed Mar. 10, 2015, to Sears et al., which is incorporated herein by reference in its entirety. As a further example, components adapted for gesture recognition based on specified movements of the non-combustible aerosol provision system may be used as an input. See U.S. Pat. App. Pub. 2016/0158782 to Henry et al., which is incorporated herein by reference in its entirety.

Although not included in the depicted implementation, some implementations may include other types of input elements, which may replace or supplement an airflow or pressure sensor. The input may be included to allow a user to control functions of the device and/or for output of information to a user. Any component or combination of components may be utilized as an input for controlling the function of the device. In some implementations, an input may comprise a computer or computing device, such as a smartphone or tablet. In particular, the non-combustible aerosol provision system may be wired to the computer or other device, such as via use of a USB cord or similar protocol. The non-combustible aerosol provision system may also communicate with a computer or other device acting as an input via wireless communication. See, for example, the systems and methods for controlling a device via a read request as described in U.S. Pat. App. Pub. No. 2016/0007561 to Ampolini et al., the disclosure of which is incorporated herein by reference in its entirety. In such embodiments, an APP or other computer program may be used in connection with a computer or other computing device to input control instructions to the non-combustible aerosol provision system, such control instructions including, for example, the ability to form an aerosol of specific composition by choosing the nicotine content and/or content of further flavors to be included. Additional representative types of sensing or detection mechanisms, structure and configuration thereof, components thereof, and general methods of operation thereof, are described in U.S. Pat. No. 5,261,424 to Sprinkel, Jr.; U.S. Pat. No. 5,372,148 to McCafferty et al.; and PCT WO 2010/003480 to Flick; which are incorporated herein by reference in their entireties.

In the depicted implementation, the pressure sensor seal 410 is configured to cover the pressure sensor 440 to protect it from any liquid and/or aerosol from an installed consumable. In such a manner, the pressure sensor seal 410 of the depicted implementation (as well as other sealing members, including the upper chassis seal 435, lower chassis seal 437, motor housing 420, and the pin seal 422) may be made of silicone rubber, boron nitride (BN) rubber, natural rubber, thermoplastic polyurethane, or another resilient material.

Although other configurations are possible, the distal end section 419 of the circuit board 434 includes the external connection element 438. In various implementations, the external connection element 438 may be configured for connecting to an external connector and/or a docking station or other power or data source. For example, in some implementations an external connector may comprise first and second connector ends that may be interconnected by a union, which may be, for example, a cord of variable length. In some implementations, the first connector end may be configured for electrical and, optionally, mechanical connection with the device, and the second connector end may be configured for connection to a computer or similar electronic device or for connection to a power source. An adaptor including a USB connector at one end and a power unit connector at an opposing end is disclosed in U.S. Pat. App. Pub. No. 2014/0261495 to Novak et al., which is incorporated herein by reference in its entirety. In the depicted implementation, the pin seal 422 is configured to seal the interface between the external connection element 438 and the end cap 424. In the depicted implementation, one or more pins of the external connection element 438 may extend through the end cap 424 of the control device as noted above. In the depicted implementation, the end cap 424 also includes a pair of end cap pins 441A, 441B that may be affixed to the end cap 424. For example, in some implementations, the end cap pins 441A, 441B may be insert-molded into the end cap 424. In some implementations, a bottom surface of the end cap pins 441A, 441B (which, in some implementations, may be flat) may be configured to provide attraction for magnets contained in an external charger assembly. In such a manner, the end cap pins 441A, 441B may be made of any material configured to be attracted by a magnet, such as various ferromagnetic materials, including, but not limited, to steel, iron, nickel, cobalt, other alloys, and/or any combination thereof. A detailed view of the end cap assembly is shown in FIG. 25.

FIG. 26 illustrates a perspective view of an end cap assembly, according to an example implementation of the present disclosure. In particular, FIG. 26 illustrates a perspective view of the end cap 424, light diffuser 426, and end cap pins 441A, 441B. As shown in the figure, the end cap 424 also includes a seal groove 442, which extends around a distal periphery of the end cap 424. The seal groove 442 of the end cap 424 is configured to receive an end cap seal 443 that provides a sealing interface between the end cap 424 and the housing 402, and in particular, an inner surface of the outer wall 404. In various implementations, the end cap seal 443 may be made of silicone rubber, boron nitride (BN) rubber, natural rubber, thermoplastic polyurethane, or another resilient material. In various implementations, the upper portions of the end cap pins 441A, 441B are configured to engage with the lower frame 412. For example, in the depicted implementation the upper portions of the end cap pins 441A, 441B are configured to create an interference or press-fit engagement with corresponding slotted openings in the lower frame 412. In various implementations, the interface between the end cap 424 and the housing 402 (e.g., via the interface between the end cap seal 443 and the inner surface of the outer housing wall 404 and/or the upper portions of the end cap pins 441A, 441B and the lower frame 412) may create a press-fit engagement with the housing 402 that is configured to be releasable so that the end cap 424 (or end cap assembly) may be removable. Additionally, or alternatively, the housings 202, 402, end caps 224, 424, upper and lower frames 206, 406, 212, 412, may be engaged via one or more snap in features or similar mechanical structure.

FIGS. 27A-27C illustrate several subassemblies that together comprise the control device 400. In particular, FIG. 27A illustrates a lower inner subassembly 447 and an upper inner subassembly 445, FIG. 27B illustrates an inner subassembly 451 and a housing subassembly 449, and FIG. 27C illustrates a main subassembly 453 and an end cap subassembly 455. In the depicted implementation, the upper inner subassembly 445 is assembled by applying glue to receiving pockets of the upper frame 406 and press-fitting the magnets 446A, 446B into the upper frame 406. In addition, the sensor seal 410 is pressed into a receiving pocket of the upper frame 406, and the upper chassis seal 435 is stretched over a receiving groove of the upper frame 406. In the depicted implementation, the lower inner subassembly 447 is assembled by soldering the battery 416 to the circuit board 434 (in the depicted implementation, the vibration motor 418 is pre-soldered to the circuit board 434). The circuit board 434 is then coupled with the battery 416 using the front foam pad 431, which may have adhesive material on both sides thereof. The motor housing 420 may then be pressed onto the vibration motor 418, such as via an interference fit. The circuit board 434 with the attached components may then be inserted into the lower frame 412, with the back foam pad 433 located in between (adhesive may be present on one or both sides of the back foam pad 433 to aid in assembly). As illustrated in FIG. 27A, the lower inner subassembly 447 and the upper inner subassembly 445 may then be assembled together via one or more snap features that may be included on the upper inner subassembly 445 and/or the lower inner subassembly 447. As illustrated in FIG. 27B, the inner subassembly 451, comprised of the lower inner subassembly 447 and the upper inner subassembly 445, may then be inserted into the housing subassembly 449, which is assembled by adhering the vent 439 on the inside of the housing 406 proximate the aperture 425 thereof. In some implementations, adhesive may be used to secure the parts together (such as, for example, by applying adhesive through one or more holes in the lower frame 412).

Although in some implementations a consumable, an aerosol generator, and a control device may be provided together as a complete non-combustible aerosol provision system generally, these components may be provided separately. For example, the present disclosure also encompasses a disposable unit for use with a reusable unit. In specific implementations, such a disposable unit (which may be a consumable as illustrated in the appended figures) can be configured to engage a reusable unit (which may be a control device and/or an aerosol generator as illustrated in the appended figures). In still other configurations, a consumable may comprise a reusable unit and a control device may comprise a disposable unit.

Although some figures described herein illustrate a consumable, an aerosol generator, and a control device in a working relationship, it is understood that the consumable, the aerosol generator, and the control device may exist as individual components. Accordingly, any discussion otherwise provided herein in relation to the components in combination also should be understood as applying to the control device and the consumable as individual and separate components.

In another aspect, the present disclosure may be directed to kits that provide a variety of components as described herein. For example, a kit may comprise a control device with one or more aerosol generators and/or consumables. A kit may further comprise a control device with one or more charging components. A kit may further comprise a control device with one or more batteries. A kit may further comprise a control device with one or more consumables and one or more charging components and/or one or more batteries. In further implementations, a kit may comprise a plurality of consumables. A kit may further comprise a plurality of consumables and one or more batteries and/or one or more charging components. In the above implementations, the consumables or the control devices may be provided with a heating member inclusive thereto. The inventive kits may further include a case (or other packaging, carrying, or storage component) that accommodates one or more of the further kit components. The case could be a reusable hard or soft container. Further, the case could be simply a box or other packaging structure.

Many modifications and other implementations of the disclosure will come to mind to one skilled in the art to which this disclosure pertains having the benefit of the teachings presented in the foregoing descriptions and the associated figures. Therefore, it is to be understood that the disclosure is not to be limited to the specific implementations disclosed herein and that modifications and other implementations are intended to be included within the scope of the appended claims. Although specific terms are employed herein, they are used in a generic and descriptive sense only and not for purposes of limitation.

What is claimed is:

1. A non-combustible aerosol provision system comprising:

a control device that includes a power source;

an aerosol generator that is removably coupleable with the control device so as to receive power from the power source and generate an aerosol from a substrate; and a consumable that is removably coupleable to one or both of the aerosol generator and the control device, the consumable including a storage compartment configured to contain the substrate, and the consumable being configured to supply the substrate to the aerosol generator, wherein the storage compartment comprises an access door disposed at a distal end thereof, the access door configured to be opened by a portion of the aerosol generator when the distal end of the storage compartment engages the aerosol generator, wherein the aerosol generator comprises a housing defining a vaporization chamber and comprising a second access door, wherein the second access door is configured to be opened by a portion of the storage compartment when the distal end of the storage compartment engages the aerosol generator.

2. The non-combustible aerosol provision system of claim 1, wherein the aerosol generator comprises a heater assembly and a liquid transport element, the liquid transport element configured to communicate with an aerosol precursor within the substrate.

3. The non-combustible aerosol provision system of claim 1, wherein the storage compartment of the consumable comprises a reservoir and the substrate comprises a liquid composition.

4. The non-combustible aerosol provision system of claim 1, wherein the access doors of the aerosol generator and the storage compartment comprise an elastomeric baffle.

5. The non-combustible aerosol provision system of claim 1, wherein the control device further comprises a controller for controlling at least one function of the aerosol provision system.

6. The non-combustible aerosol provision system of claim 1, wherein:

the control device includes an outer housing defining a proximal end and a distal end, the proximal end of the control device defining a receiving chamber for at least partially receiving the aerosol generator, the power source disposed within the outer housing;

the aerosol generator is coupled to the proximal end of the housing; and the consumable further comprises a mouthpiece having a proximal end configured to engage with a user's mouth and a distal end configured to engage a proximal end of the storage compartment, wherein the storage compartment has a distal end configured to engage the aerosol generator.

7. The non-combustible aerosol provision system of claim 1, wherein the storage compartment further comprises an elastomeric seal configured to engage with the aerosol generator to prevent leakage.

8. The non-combustible aerosol provision system of claim 7, wherein the storage compartment further comprises a split valve configured to engage the aerosol generator and provide fluid communication between the storage compartment and the vaporization chamber.

9. The non-combustible aerosol provision system of claim 8, wherein the liquid transport element comprises a rigid or semi-rigid fluid delivery channel configured to engage the split valve of the storage compartment.

10. The non-combustible aerosol provision system of claim 6, wherein a vaporization chamber of the aerosol generator is in fluid communication with the consumable via two separate airflow channels that merge at the proximal end of the mouthpiece.

11. The non-combustible aerosol provision system of claim 6, wherein an airflow inlet is defined by a gap between the consumable and one or both of the control device and the aerosol generator, the airflow entering a vaporization chamber of the aerosol generator and an aerosol flow exits the vaporization chamber via a first path and a second path, wherein the aerosol flow paths are symmetrical.

12. The non-combustible aerosol provision system of claim 2, wherein at least one of the liquid transport element or the heater assembly comprises a ceramic material.

* * * * *